US010870985B2

(12) United States Patent
Rodden

(10) Patent No.: US 10,870,985 B2
(45) Date of Patent: Dec. 22, 2020

(54) CONCRETE SLAB LOAD TRANSFER AND CONNECTION APPARATUS AND METHOD OF EMPLOYING SAME

(71) Applicant: Illinois Tool Works Inc., Glenview, IL (US)

(72) Inventor: Robert Alan Rodden, Atlanta, GA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/967,689

(22) Filed: May 1, 2018

(65) Prior Publication Data

US 2018/0320373 A1 Nov. 8, 2018

Related U.S. Application Data

(60) Provisional application No. 62/500,756, filed on May 3, 2017.

(51) Int. Cl.

| | |
|---|---|
| ***E01C 11/02*** | (2006.01) |
| ***E01C 11/14*** | (2006.01) |
| ***E01C 11/16*** | (2006.01) |
| ***E04B 5/32*** | (2006.01) |
| ***E01C 11/06*** | (2006.01) |
| *E01C 11/18* | (2006.01) |

(52) U.S. Cl.

CPC ..... *E04B 5/32* (2013.01); *E01C 11/06* (2013.01); *E01C 11/14* (2013.01); *E01C 11/02* (2013.01); *E01C 11/18* (2013.01); *E04B 2103/02* (2013.01)

(58) Field of Classification Search

CPC ..... E01C 11/00; E01C 11/02; E01C 11/04; E01C 11/14; E01C 11/16; E01C 11/18; E01C 1/02; E01C 1/00; E04C 5/16; E04C 5/162; E04C 5/166; E04C 5/00; E04C 5/06; E04C 5/167; B29C 65/48; B29C 65/565

See application file for complete search history.

(56) References Cited

U.S. PATENT DOCUMENTS

| | | | | |
|---|---|---|---|---|
| 1,436,896 A | | 11/1922 | Newell | |
| 1,863,115 A | * | 6/1932 | Heltzel | E01C 11/08 404/136 |
| 1,942,494 A | * | 1/1934 | Robertson | E01C 11/14 404/60 |
| 1,991,931 A | | 2/1935 | Kling et al. | |

(Continued)

FOREIGN PATENT DOCUMENTS

| | | |
|---|---|---|
| ES | 2 149 103 | 10/2000 |
| WO | WO 00/01890 | 1/2000 |
| WO | WO 02/12630 | 2/2002 |

OTHER PUBLICATIONS

International Search Report and Written Opinion from International Application No. PCT/US2018/030610, mailed025 Oct. 16, 2018 (12 pages).

(Continued)

*Primary Examiner* — Phi Dieu Tran A

(74) *Attorney, Agent, or Firm* — Neal, Gerber & Eisenberg LLP

(57) ABSTRACT

Various embodiments of the present disclosure provide a cast-in-place concrete slab load transfer and slab connection apparatus and method of employing same.

16 Claims, 13 Drawing Sheets

(56) References Cited

U.S. PATENT DOCUMENTS 2,093,697 A * 9/1937 Scholer ..... E01C 11/14 404/62
2,164,590 A * 7/1939 Oates ..... E01C 11/14 404/61
2,192,571 A * 3/1940 Bitney ..... E01C 11/14 404/63
2,575,247 A * 11/1951 Carter ..... E01C 11/14 404/60
2,627,793 A * 2/1953 White ..... E01C 11/14 404/62
2,783,695 A 3/1957 De Canio
2,864,289 A * 12/1958 De Canio ..... E01C 11/14 404/62
3,022,713 A 2/1962 Friberg
3,059,553 A 10/1962 Woolley
3,104,600 A * 9/1963 White ..... E01C 11/14 29/283
3,279,335 A * 10/1966 Garner ..... E01C 11/14 404/62
3,437,017 A * 4/1969 Walz ..... E01C 11/14 404/60
3,702,093 A * 11/1972 Van de Loock ..... E01C 11/14 404/62
4,653,956 A 3/1987 Lang
5,366,319 A * 11/1994 Hu ..... E01C 11/106 404/52
6,019,546 A * 2/2000 Ruiz ..... E01C 11/14 404/134
6,052,964 A * 4/2000 Ferm ..... E01C 7/147 404/64
6,210,070 B1 * 4/2001 Shaw ..... E01C 11/14 404/62
6,409,423 B1 6/2002 Li
6,592,289 B1 7/2003 Weander
6,688,808 B2 2/2004 Lee
6,745,532 B1 6/2004 Vazquez Ruiz del Arbol
7,481,031 B2 1/2009 Boxall et al.
7,571,581 B2 8/2009 Covarrubias
7,637,689 B2 12/2009 Boxall et al.
7,716,890 B2 5/2010 Boxall et al.
7,784,235 B2 * 8/2010 Cretti ..... E04B 5/19 52/309.12
8,381,470 B2 2/2013 Boxall et al.
8,511,935 B1 * 8/2013 Thomas ..... E01C 11/14 404/135
8,627,626 B2 1/2014 Boxall et al.
8,844,224 B2 * 9/2014 Lindquist ..... E04C 5/16 52/294
10,280,568 B2 * 5/2019 McDonald ..... E01C 11/14
2005/0220539 A1 10/2005 Yee
2010/0242401 A1 * 9/2010 Boxall ..... E01C 11/14 52/699
2015/0013262 A1 1/2015 Wilkes et al.
2015/0110555 A1 4/2015 Covarrubias Vidal
2016/0017548 A1 * 1/2016 Schenk ..... E01C 11/06 404/62

OTHER PUBLICATIONS

PD$^3$ Basket Assembly, product data sheet, PNA™ Construction Technologies, published Jan. 2010 (2 pages).

* cited by examiner

10A

10C

CONCRETE SLAB LOAD TRANSFER AND CONNECTION APPARATUS AND METHOD OF EMPLOYING SAME

PRIORITY

This application claims priority to and the benefit of U.S. Provisional Patent Application Ser. No. 62/500,756, filed May 3, 2017, the entire contents of which are incorporated herein by reference.

BACKGROUND

Concrete floors and roadways typically include a series of separate individually poured or cast-in-place concrete slabs. Construction joints are typically used to join or are formed at and between such separately individually poured adjacent concrete slabs (i.e., adjacent concrete slabs that are poured at different or sequential times). For example, longitudinally extending construction joints are typically used to form joints between the concrete slabs of adjacent lanes of a roadway. Transverse construction joints are also typically used to join the adjacent transverse ends or transverse vertically extending edges of certain adjacent concrete slabs that are separately individually poured (such as concrete slabs in a single lane of a roadway that are poured on sequential days).

Concrete floors and roadways can also be made up of concrete slabs that are formed from larger concrete slabs that are individually poured or cast-in-place. Such concrete slabs that are formed from such larger concrete slabs are often made by employing or forming one or more contraction joints in the larger concrete slabs. Contraction joints (which are also sometimes called control joints) are used to control naturally or randomly occurring cracking in concrete floors or roadways from stresses caused by concrete shrinkage, thermal contraction, moisture or thermal gradients within the concrete, and/or various external forces on the concrete floors or roadways. Contraction joints are typically formed by vertically cutting the concrete floors or roadways along or at the area of the desired location of the contraction joint. Contraction joints are typically vertically sawed into the concrete and often extend approximately one third of the way through the depth of the concrete. When the larger concrete slab cracks along the contraction joint, the smaller concrete slabs are formed.

It should be appreciated that the term concrete slab as used herein is meant to include a separately individually poured or cast-in-place concrete slab or a concrete slab formed from a larger concrete slab.

Concrete floors typically include numerous construction joints and/or contraction joints. Concrete roadways typically include numerous construction joints and contraction joints.

Specific requirements for each type of joint depend upon many factors including, but not limited to: (a) the joint's orientation to the direction of the traveling load (i.e., transverse or longitudinal); (b) load transfer requirements between adjacent concrete slabs; and (c) if the joint is located at an edge of construction or if it is sawed.

Different types of known tie bars and dowels are typically respectively used in forming such construction and contraction joints. Certain known tie bars are used to connect adjacent concrete slabs to cause the adjacent concrete slabs to move together. Certain known dowels are used to facilitate load transfers between adjacent concrete slabs.

FIG. 1 illustrates the placement of various known apparatuses (including various known tie bars and dowels) respectively used to form certain types of construction and contraction joints of or for a concrete roadway. More specifically, FIG. 1 shows a section of an example three lane concrete roadway 10 being constructed. This type of roadway is one of the common types of concrete roadway configurations currently employed in the United States (and various other countries). Each concrete slab of this example roadway is as wide as a lane of traffic (which is typically 12 to 14 feet wide).

The illustrated section of this roadway 10 at this point of the construction process generally includes a first poured and set concrete slab 12, a second poured and set concrete slab 14, and a third concrete slab 16 that is in the process of being poured and formed by a conventional forming machine 15. This example roadway 10 includes: (a) an illustrated first series of transversely extending tie bars (such as tie bar 22) secured in and extending from the vertical side edge of the first concrete slab 12; and (b) an illustrated second series of transversely extending tie bars (such as tie bar 24) secured in and extending from the vertical side edge of second concrete slab 14. In this illustrated example roadway, these tie bars are steel reinforcing bars (such as rebar) that have been: (a) secured in the respective concrete slabs 12 and 14 shortly after the pouring process and before the concrete is cured or set; or (b) inserted in and secured (such as by epoxy) in transversely drilled holes in the vertical edges of the poured and set concrete slabs 12 and 14. The tie bars include irregular surfaces to increase the mechanical bond or connection between the tie bar and the concrete.

The first series of tie bars are employed for the construction joint between the first concrete slab 12 and the third concrete slab 16. The first series of tie bars are thus in part used to connect the first concrete slab 12 and the third concrete slab 16, such that if either of the first concrete slab 12 or the third concrete slab 16 moves, the other concrete slab moves in the same direction as or with the moving slab (as is well known in the art). In other words, the first series of tie bars are in part used to hold together the adjacent lanes formed by the first concrete slab 12 and the third concrete slab 16. This is very important in roadway construction to avoid gaps between adjacent lanes that can lead to deterioration of the roadway and can be potentially dangerous for vehicles such as motorcycles.

Likewise, the second series of tie bars are employed for the construction joint between the second concrete slab 14 and the third concrete slab 16. The second series of tie bars are thus in part used to connect the second concrete slab 14 and the third concrete slab 16, such that if either of the second concrete slab 14 or the third concrete slab 16 moves, the other concrete slab moves in the same direction (as is well known in the art). In other words, the second series of tie bars are in part used to hold together the lanes formed by the second concrete slab 14 and the third concrete slab 16.

This example roadway 10 further includes an illustrated series of longitudinally extending dowels (such as dowel 28) each positioned along a transversely extending axis across the third concrete slab 16. These dowels are supported by one or more dowel baskets (not labeled). This series of dowels are employed for a transversely extending contraction joint formed in the concrete slab 16. Prior to pouring the concrete of the slab 16, these dowels and the dowel basket(s) supporting these dowels are positioned or pre-placed on the grade or sub-surface 8 at the area or location where a transverse saw cut contraction joint will be created in the third concrete slab 16. The dowels and dowel basket(s) are positioned such that: (a) the first leg(s) of dowel basket(s)

will be imbedded in or positioned completely in a first one of two adjacent concrete slabs (after the contraction joint formed) as generally shown in FIG. 2B; and (b) the second leg(s) of dowel basket(s) will be imbedded in or positioned completely in a second adjacent one of the concrete slabs (after the contraction joint is formed). This is generally shown in FIG. 2B. The dowels and dowel basket(s) are positioned such that each of the dowels extends into both such adjacent concrete slabs (after the contraction joint is formed) in the concrete slab 16 for load transfer purposes. These known dowels have smooth outer surfaces and are movable with respect to either of the adjacent concrete slabs. In certain deployments, a lubricant is used on these dowels to ensure such relative movement.

This series of dowels are thus used to transfer loads between adjacent sections of the third concrete slab 16 after the contraction joint has been formed. These dowels are shown as cylindrical members in FIG. 1. It is known to provide these dowels in the form of flat tapered load transfer plates as shown in U.S. Pat. Nos. 7,716,890, 7,481,031, and 8,381,470. U.S. Pat. Nos. 7,716,890, 7,481,031, and 8,381,470 explain the use and advantages provided by such flat tapered load transfer plates for such contraction joints.

FIGS. 2A and 2B further schematically illustrate a section of this example roadway 10. This illustrated section of roadway 10 includes lanes 52 and 54. FIGS. 2A and 2B illustrate: (a) the first concrete slab 12 (that forms a longitudinal section of lane 52); and (b) the adjacent third concrete slab 16 (that forms a longitudinal section of lane 54,) after both of the concrete slabs have been poured and set. FIGS. 2A and 2B also illustrate the respective positions of certain of the tie bars, dowels, and joints for this section of this concrete roadway 10.

More specifically, FIGS. 2A and 2B illustrate: (a) the longitudinally extending construction joint 30 extending between the first concrete slab 12 and the third concrete slab 16; (b) the transversely extending contraction joints 32, 34, 36, and 38 formed in the first concrete slab 12 (and thus the formed concrete slabs 12A, 12B, and 12C); and (c) the transversely extending contraction joints 42, 44, 46, and 48 formed in the third concrete slab 16 (and thus the formed concrete slabs 16A, 16B, and 16C).

FIG. 2B further illustrates: (a) the first series of tie bars at the longitudinally extending construction joint 30 extending in and between the first concrete slab 12 and the third concrete slab 16; (b) eight transversely extending series of dowel baskets (labeled 26A, 26B, 26C, 26D, 26E, 26F, 26G, and 26H) respectively at the transversely extending contraction joints 32, 34, 36, 38, 42, 44, 46, and 48. Each respective series of dowels are supported by one or more dowel baskets sized to fit substantially across the width of the respective transverse contraction joint. The illustrated dowel baskets are almost as wide as a single lane (i.e., either lane 52 or lane 54), and each of the dowel baskets 26A, 26B, 26C, 26D, 26E, 26F, 26G, and 26H does not continue across the longitudinal construction joint 30.

In FIGS. 2A and 2B, the rectangles 50*a*, 50*b*, 50*c*, and 50*d* represent the footprint of the wheels of an example vehicle (not shown) on the roadway 10. All of the wheels and thus all of the weight of the example vehicle are positioned on the same concrete slab (such as 16B) at one or more points in time. This weight distribution can cause various problems with and wear on such concrete slabs. Certain of these problems are described in U.S. Pat. No. 7,751,581. U.S. Pat. No. 7,751,581 also proposes a potential solution to these problems. Very generally, the proposed potential solution is to make the concrete slabs shorter and narrower such that at any one point in time, only one wheel of the vehicle and thus only a portion of the weight of that vehicle is positioned on each respective concrete slab at each point in time.

One example implementation of this potential solution is generally shown in FIG. 3. The implementation shown in FIG. 3 includes substantially more concrete slabs for the same size section of the roadway 10A as the roadway 10 shown in FIGS. 2A and 2B. This section of roadway 10A in FIG. 3 includes: (a) lanes 52 and 54; (b) concrete slabs 60A, 60B, 60C, 60D, 60E, 60F, and 60G of lane 52; (c) concrete slabs 62A, 62B, 62C, 62D, 62E, 62F, and 62G of lane 52; (d) concrete slabs 64A, 64B, 64C, 64D, 64E, 64F, and 64G of lane 54; and (e) concrete slabs 66A, 66B, 66C, 66D, 66E, 66F, and 66G of lane 54. Thus, each lane of this section of roadway 10A includes transversely adjacent concrete slabs.

One potential advantage with this proposed potential solution is that the concrete slabs can be made relatively thinner (i.e., with less height or thickness) because they each bear less weight. This can result in substantial savings on concrete related expenses.

However, this proposed potential solution has certain disadvantages. Certain such potential disadvantages of this proposed potential solution relate to the potential increase in the number and placement of baskets and dowels and the related additional time and expense needed to purchase, assemble, and place or position such dowels and baskets for the substantially increased number of contraction and construction joints.

Accordingly, there is a need to solve these potential problems and disadvantages for this proposed potential solution, and to provide an improved concrete slab load transfer and connection apparatus and methods of employing same for concrete slabs of floors and roadways.

SUMMARY

Various embodiments of the present disclosure provide concrete slab load transfer and connection apparatuses and methods of employing same that solves the above potential problems and that provides improved concrete slab load transfer and connection apparatuses and methods of employing same for all concrete slabs of floors and roadways.

Various embodiments of the present disclosure provide a concrete slab load transfer and connection apparatus that employs an entire dowel basket or certain parts of a dowel basket (configured to support dowels for one or more contraction joints between pairs of adjacent concrete slabs) as the slab connection members for another contraction joint at or between certain of those adjacent concrete slabs. Likewise, various embodiments of the present disclosure provide a method of using such a basket such that the slab connection members are positioned in the concrete slabs at the area where a contraction joint will be formed at or between adjacent concrete slabs to connect such adjacent concrete slabs.

Various embodiments of the present disclosure provide a concrete slab load transfer and connection apparatus that employs slab connection members attached to certain parts of a dowel basket (configured to support dowels for one or more contraction joints between pairs of adjacent concrete slabs) for another contraction joint at or between certain of those adjacent concrete slabs. Likewise, various embodiments of the present disclosure provide a method of using such a basket such that the slab connection members are positioned in the concrete slabs at the area where a contraction joint will be formed at or between adjacent concrete slabs to connect such adjacent concrete slabs.

Various embodiments of the present disclosure provide a concrete slab load transfer and connection apparatus that employs slab connection members attached to multiple baskets (configured to support dowels for one or more contraction joints between pairs of adjacent concrete slabs) for another contraction joint at or between certain of those adjacent concrete slabs. Likewise, various embodiments of the present disclosure provide a method of using such baskets and such slab connection members such that the slab connection members are positioned in the concrete slabs at the area where a contraction joint will be formed at or between adjacent concrete slabs to connect such adjacent concrete slabs.

Additional features and advantages of the present invention are described in, and will be apparent from, the following Detailed Description and the Figures.

DETAILED DESCRIPTION OF EXAMPLE EMBODIMENTS

Various embodiments of the present disclosure provide a concrete slab load transfer and connection apparatus and methods of employing same that solves the above problems. For brevity, the concrete slab load transfer and connection apparatus may sometimes be referred to herein as the transfer and connection apparatus or as the apparatus.

1st Example Embodiment

Figure 1:
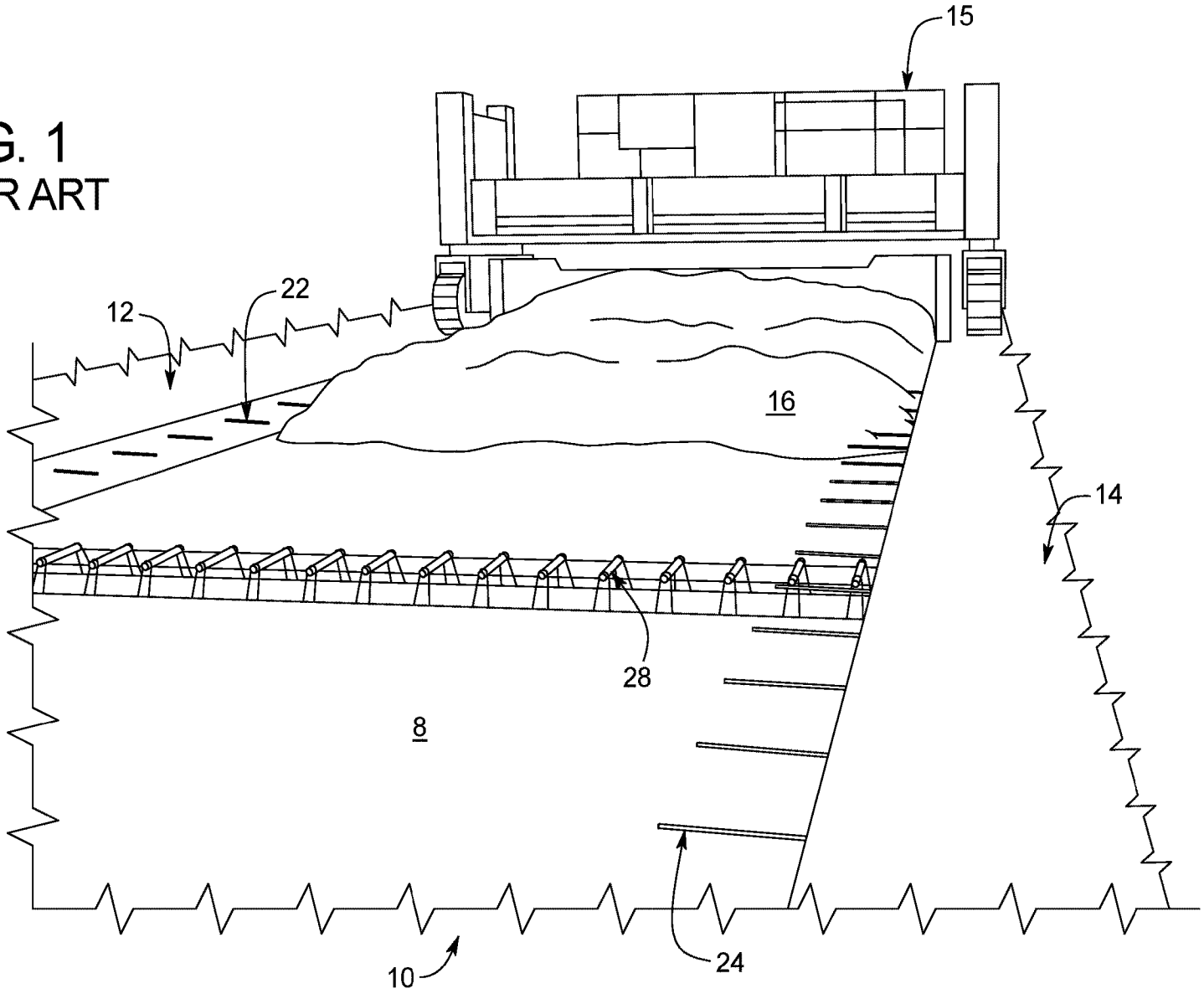
FIG. 1 PRIOR ART
FIG. 1 is a fragmentary perspective view of a section of a known example roadway being constructed.
Figure 2A:
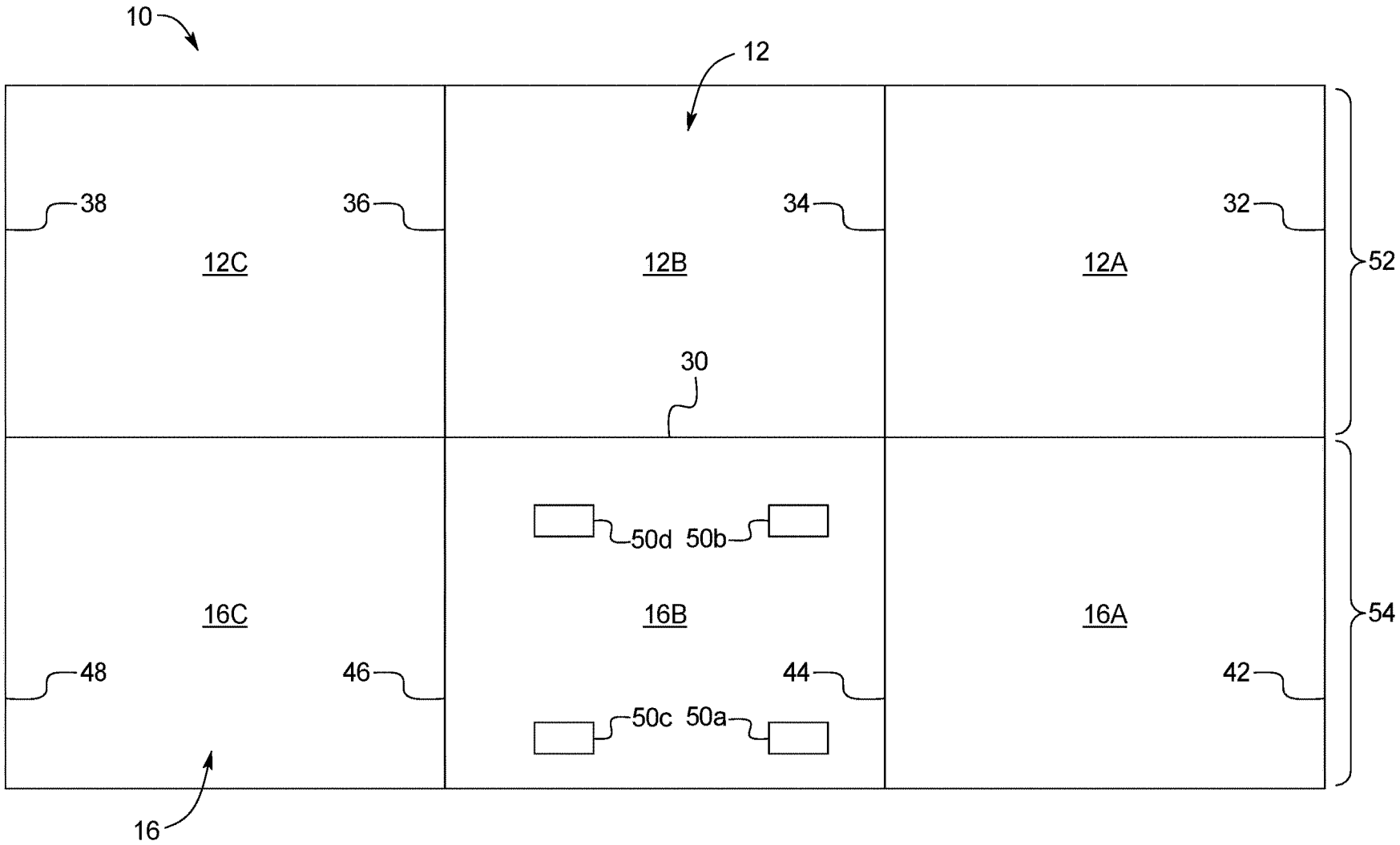
FIG. 2A PRIOR ART
FIG. 2A is top view of a section of the example roadway of FIG. 1 after the illustrated concrete slabs have been poured and formed, and after the contraction joints have been sawcut.
Figure 2B:
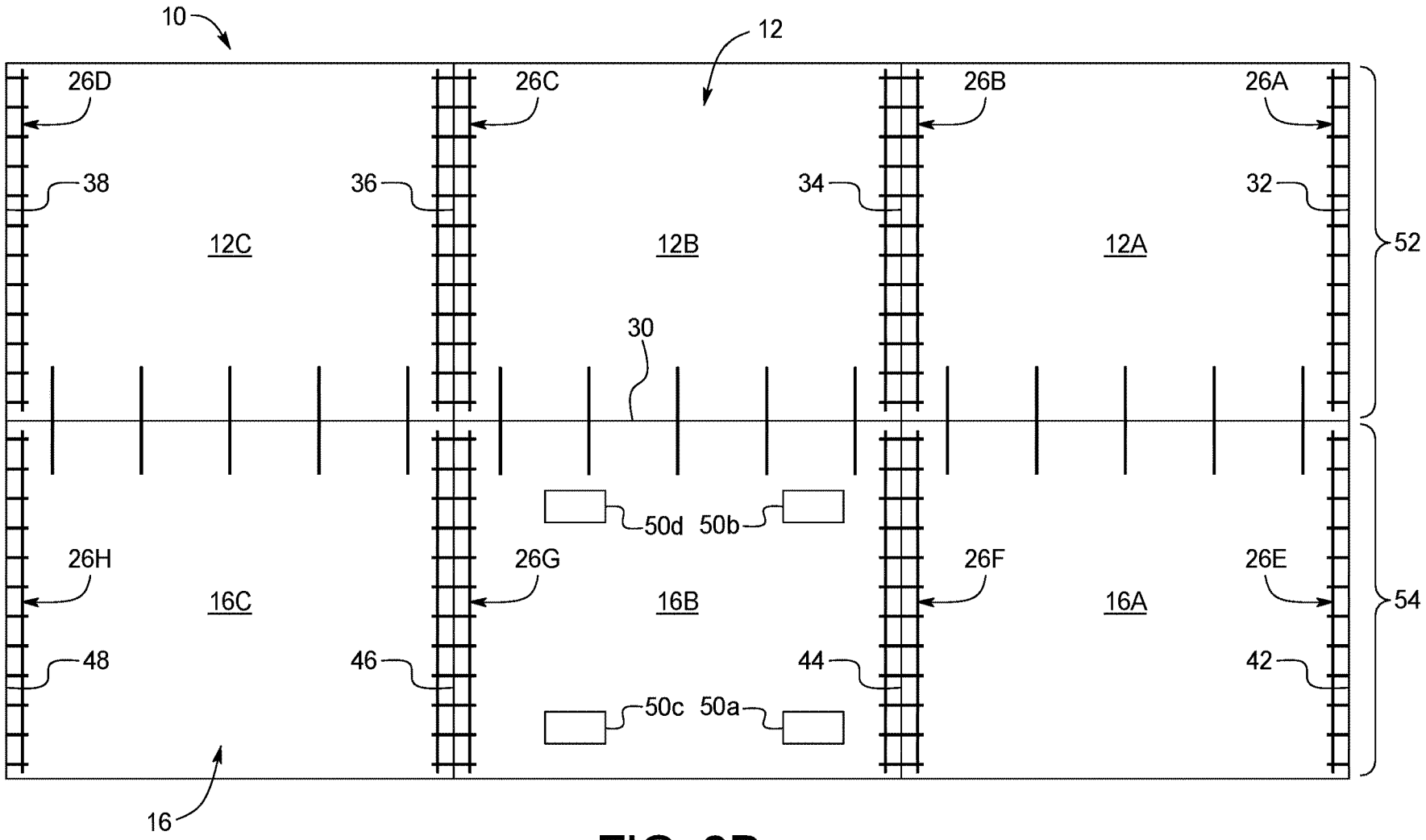
FIG. 2B PRIOR ART
FIG. 2B is top diagramatic view of a section of the example roadway of FIG. 1 after the illustrated concrete slabs have been poured and formed, after the contraction joints have been sawcut, and showing the respective series of dowels embedded in the concrete slabs relative to the construction and contraction joints.
Figure 3:
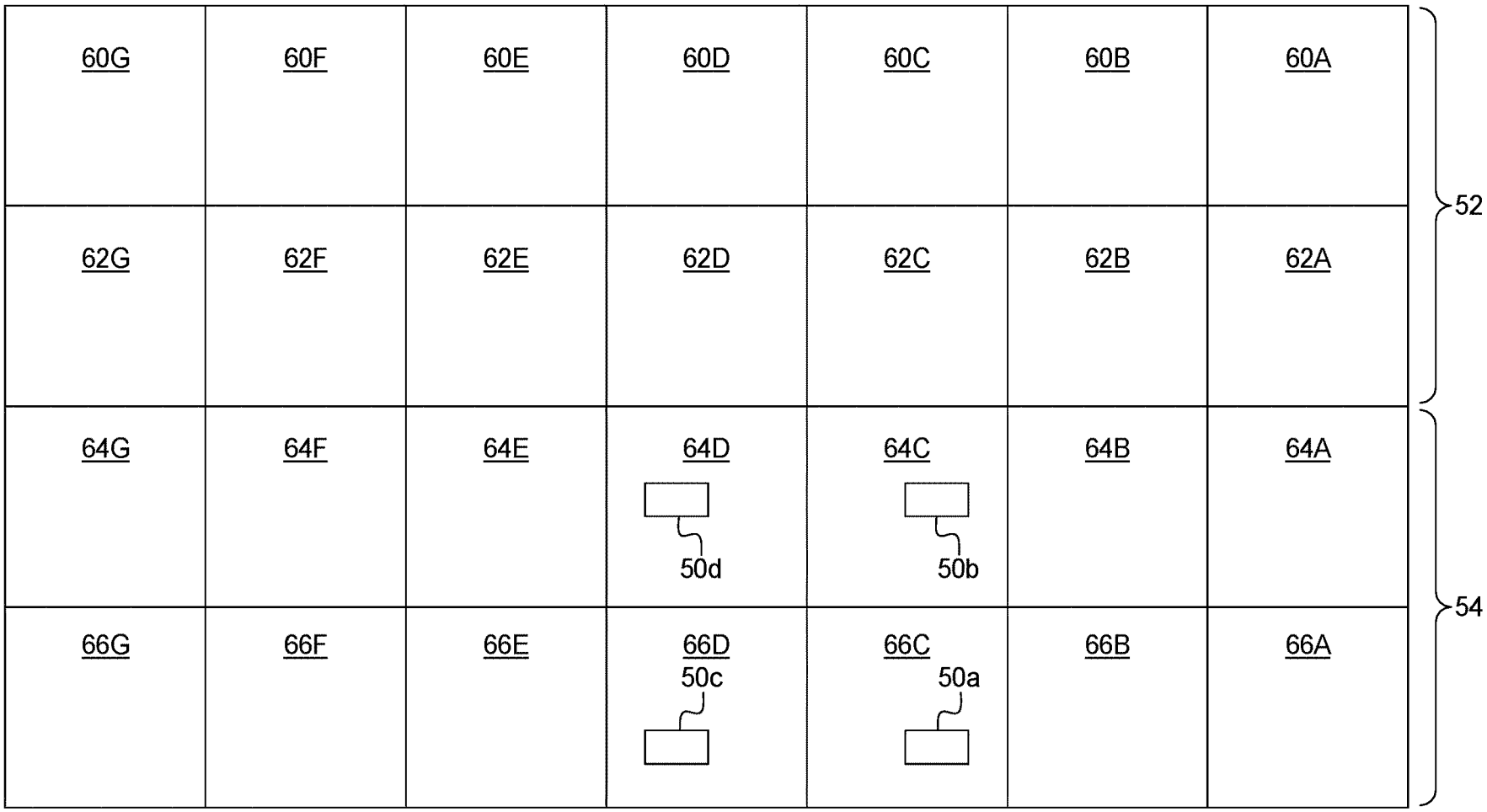
FIG. 3 is top view of a section of a new proposed roadway configuration after the illustrated concrete slabs have been poured and formed, and after the construction and contraction joints have been formed.
Figure 4:
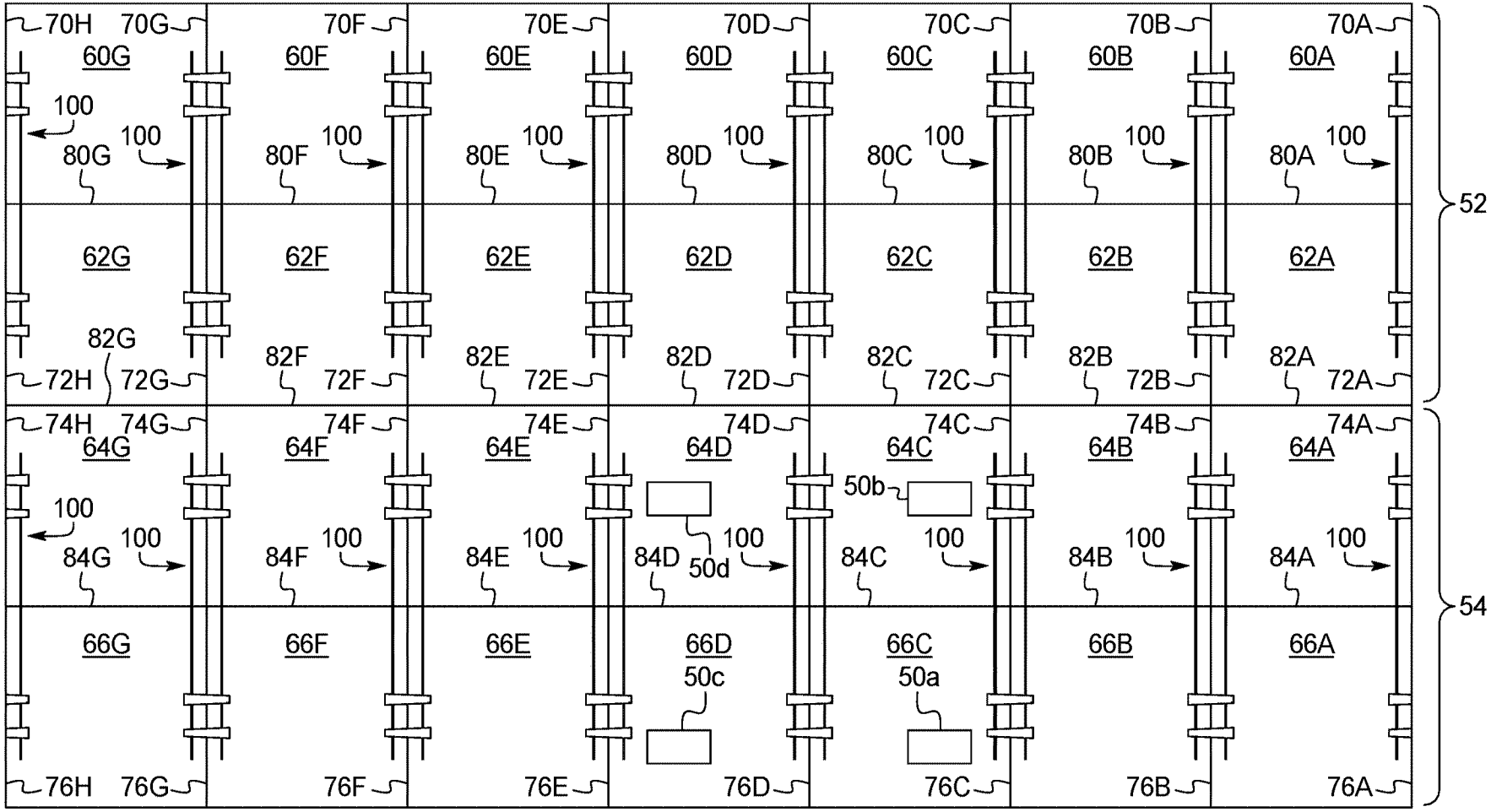
FIG. 4 is top diagramatic view of a section of the new proposed roadway of FIG. 3 constructed employing one example embodiment of the concrete slab load transfer and connection apparatus and method of employing same of the present disclosure, and showing the relative positions of the concrete slab load transfer and connection apparatus of this example embodiment of the present disclosure.
Figure 5:
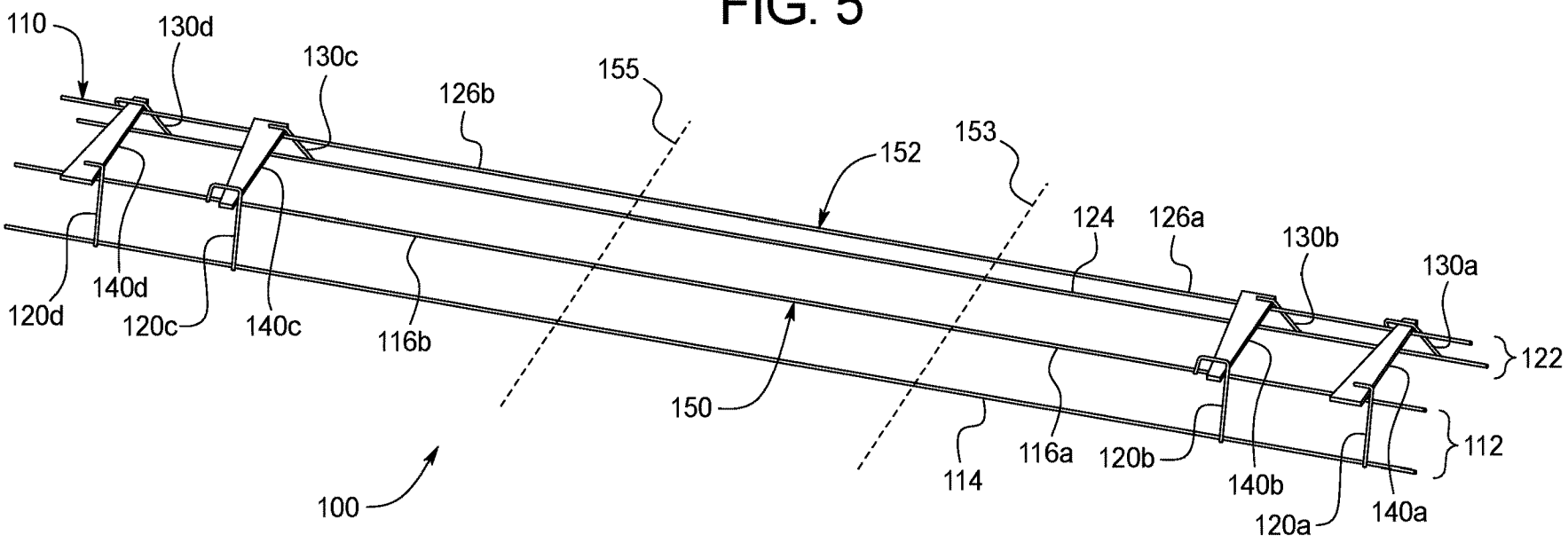
FIG. 5 is a perspective view of the example embodiment of the concrete slab load transfer and connection apparatus of the present disclosure employed in the section of the roadway of FIG. 4.
Figure 6:
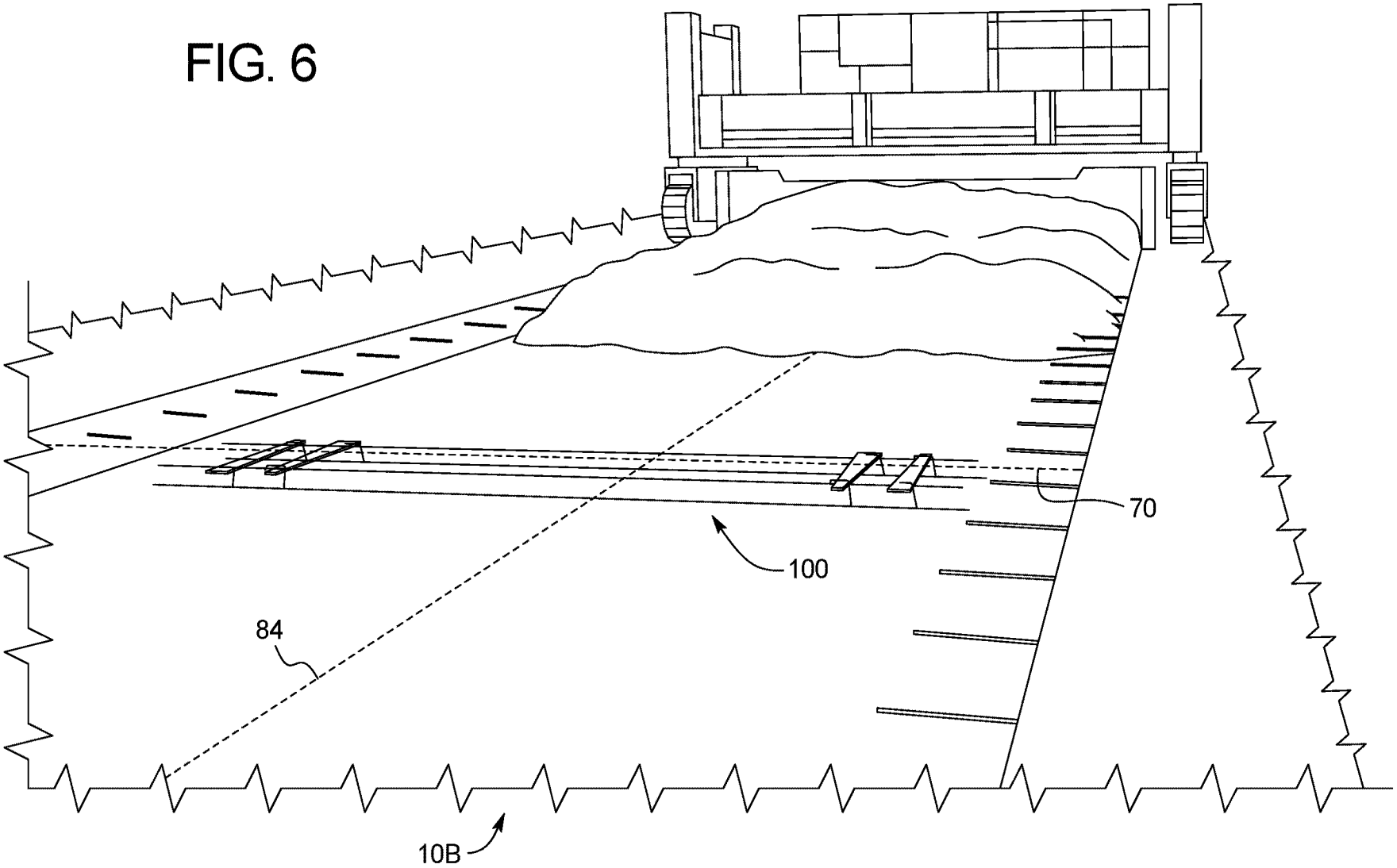
FIG. 6 is a fragmentary perspective view of the section of the roadway of FIG. 4 being constructed with the concrete slab load transfer and connection apparatus of FIGS. 4 and 5.

One example embodiment of the concrete slab load transfer and connection apparatus and a method of employing same are generally illustrated in FIGS. 4, 5, and 6. This example embodiment of the concrete slab load transfer and connection apparatus of the present disclosure is generally indicated by numeral 100. FIGS. 4, 5, and 6 also illustrate parts of a section of a roadway 10B. This section of roadway 10B includes: (a) lanes 52 and 54; (b) concrete slabs 60A, 60B, 60C, 60D, 60E, 60F, and 60G of lane 52; (c) concrete slabs 62A, 62B, 62C, 62D, 62E, 62F, and 62G of lane 52; (d) concrete slabs 64A, 64B, 64C, 64D, 64E, 64F, and 64G of lane 54; and (e) concrete slabs 66A, 66B, 66C, 66D, 66E, 66F, and 66G of lane 54. This section of the roadway 10B further includes: (a) transversely extending contraction joints 70A, 70B, 70C, 70D, 70E, 70F, 70G, and 70H in or of the lane 52; (b) transversely extending contraction joints 72A, 72B, 72C, 72D, 72E, 72F, 72G, and 72H in or of the lane 52; (c) transversely extending contraction joints 74A, 74B, 74C, 74D, 74E, 74F, 74G, and 74H in or of the lane 54; and (d) transversely extending contraction joints 76A, 76B, 76C, 76D, 76E, 76F, 76G, and 76H in or of the lane 54. This section of the roadway 10B further includes: (a) longitudinally extending contraction joints 80A, 80B, 80C, 80D, 80E, 80F, and 80G in or of the lane 52; and (b) longitudinally extending contraction joints 84A, 84B, 84C, 84D, 84E, 84F, and 84G, in or of the lane 54. This section of the roadway 10B further includes a longitudinally extending construction joint indicated by numerals 82A, 82B, 82C, 82D, 82E, 82F, and 82G at or extending between the lanes 52 and 54.

This illustrated section of the roadway 10B employs sixteen of the same concrete slab load transfer and connection apparatus that are each labeled with the same reference numeral 100. Each of these concrete slab load transfer and connection apparatus 100 simultaneously serves at least two separate functions in accordance with the present disclosure. The first function is to provide or position the dowels for the load transfer at each of the contraction joints formed between each respective set or pair of longitudinally adjacent concrete slabs (such as for the contraction joint 74D at or between slabs 64C and 64D in or of lane 54 and for the contraction joint 76D at or between slabs 66C and 66D in or of lane 54). The second function is to provide the slab connection members or slab connectors for connecting a set or pair of transversely adjacent concrete slabs in a lane (such as for the contraction joint indicated by 84C and 84D between concrete slabs 64C and 66C and 66C and 66D in or of lane 54). Thus, the concrete slab load transfer and connection apparatus 100 simultaneously serves to provide load transfer between one or more sets or pairs of longitudinally adjacent concrete slabs and to connect one of more sets or pairs of transversely adjacent concrete slabs (and wherein those concrete slabs can be from the same group of concrete slabs).

More specifically, in the illustrated embodiment of FIGS. 4, 5, and 6, this concrete slab load transfer and connection apparatus 100 generally includes: (a) a plurality of load transfer dowels or members such as load transfer plates 140*a*, 140*b*, 140*c*, and 140*d*; (b) a basket 110 configured to support the load transfer members (such as load transfer dowels or plates 140*a*, 140*b*, 140*c*, and 140*d*); and (c) a plurality of slab connection members such as slab connection members 150 and 152.

The basket 110 in this illustrated example embodiment includes a first leg 112 and a spaced apart second leg 122. The first leg 112 includes a lower elongated member 114, a first upper elongated member 116*a*, and a second upper elongated member 116*b*. The first leg 112 further includes four dowel holding hands 120*a*, 120*b*, 120*c*, and 120*d* respectively integrally connected to members 114, 116*a*, and 116*b*. Likewise, the second leg 122 includes a lower elongated member 124, a first upper elongated member 126*a*, and a second upper elongated member 126*b*. The second leg 122 further includes four dowel holding hands 130*a*, 130*b*, 130*c*, and 130*d* respectively integrally connected member 124, 126*a*, and 126*b*.

The first and second legs 112 and 122 are configured to co-act to hold and support a plurality of load transfer members and particularly the load transfer dowels or plates 140*a* and 140*b* at or along an area where a transversely extending contraction joint such as the transversely extending contraction joint 76D at or between longitudinally adjacent slabs 66C and 66D will be formed as generally shown in FIGS. 4 and 6.

The first and second legs 112 and 122 are also configured to co-act to hold and support a plurality of load transfer members and particularly the load transfer dowels or plates 140*c* and 140*d* at or along an area where a transversely extending contraction joint such as the transversely extending contraction joint 74D at or between longitudinally adjacent slabs 64C and 64D as generally shown in FIGS. 4 and 6.

The tapered load transfer dowels or plates 140*a*, 140*b*, 140*c*, and 140*d*, are supported by the basket 110 and specifically supported by the first leg 112 and the second leg 122 in opposing fashion in this illustrated example embodiment. More specifically; in this illustrated example embodiment: (a) the wider end of the tapered load transfer plate 140*a* is supported and held in place by the first upper elongated member 116*a* and the dowel holding hand 120*a*; (b) the narrower end of the tapered load transfer plate 140*a* is supported and held in place by the upper elongated member 126*a* and the dowel holding hand 130*a*; (c) the narrower end of the tapered load transfer plate 140*b* is supported and held in place by the first upper elongated member 116*a* and the dowel holding hand 120*b*; (d) the wider end of the tapered load transfer plate 140*b* is supported and held in place by the upper elongated member 126*a* and the dowel holding hand 130*b*; (e) the narrower end of the tapered load transfer plate 140*c* is supported and held in place by the first upper elongated member 116*b* and the dowel holding hand 120*c*; (f) the wider end of the tapered load transfer plate 140*c* is supported and held in place by the upper elongated member 126*b* and the dowel holding hand 130*c*; (g) the wider end of the tapered load transfer plate 140*d* is supported and held in place by the first upper elongated member 116*b* and the dowel holding hand 120*d*; and (h) the narrower end of the tapered load transfer plate 140*d* is supported and held in place by the upper elongated member 126*b* and the dowel holding hand 130*d*.

It should be appreciated that the directions of the respective tapers of the load transfer plates 140*a*, 140*b*, 140*c*, and 140*d* alternate from one tapered load transfer plate to the adjacent tapered load transfer plate. For contraction joints, if the center of the contraction joint ends up positioned somewhat off-center relative to these tapered load plates 140*a*, 140*b*, 140*c*, and 140*d*, the alternating pattern of tapered load plates 140*a*, 140*b*, 140*c*, and 140*d* in the basket 110 allows or compensates for this misalignment.

In this illustrated embodiment, each tapered load plate 140*a*, 140*b*, 140*c*, and 140*d* has a top tapered planar surface and a bottom tapered planar surface. The top and bottom flat surfaces are substantially parallel to one another in this illustrated example embodiment. In this illustrated example embodiment, the top and bottom surfaces taper from approximately 4 inches wide to a narrow end approximately 1 inch wide over a length of approximately 12 inches. It should be appreciated that the other suitable tapered shapes and/or other suitable shapes and dimensions may also be employed in accordance with the present disclosure. The advantages provided by these tapered load transfer plates are described in U.S. Pat. Nos. 7,716,890, 7,481,031, and 8,381,470.

The plurality of slab connection members or slab connectors 150 and 152 of the concrete slab load transfer and connection apparatus 100 of this illustrated example embodiment in FIGS. 4, 5, and 6, are respectively integrally formed with the legs 112 and 122 of the basket 110. More specifically, the slab connection member 150 includes an elongated generally cylindrical rod having two opposing ends integrally respectively connected to the first upper elongated member 116*a* and the second upper elongated member 116*b* of the leg 112 of the basket 110. Likewise, the slab connection member 152 is an elongated generally cylindrical rod having two opposing ends integrally respectively connected to the first upper elongated member 126*a* and the second upper elongated member 126*b* of the leg 122 of the basket 110. The dotted lines 153 and 155 in FIG. 5 generally indicate the respective connections areas between the slab connection members 150 and 152 and the legs 112 and 122 of the basket 110 in this illustrated example embodiment. It should be appreciated that the lengths of these members may vary in accordance with the present disclosure. The slab connection members 150 and 152 are made from rebar in certain embodiments and have suitable rough or irregular surfaces that increase the surface area engagement between such connection members and the respective concrete slabs. It should also be appreciated that the legs 112 and 122 of the basket 110 and the components thereof act to secure the apparatus 100 in the respective adjacent concrete slabs (such as the transversely adjacent concrete slabs).

It should thus be appreciated from the above that in this illustrated example embodiment of present disclosure, each concrete slab load transfer and connection apparatus 100 is configured to be used or positioned such that: (a) the load transfer plates of that apparatus 100 are positioned for load transfer at an area where a contraction joint will be formed between a set or pair of longitudinally adjacent concrete slabs (such as for the contraction joint 76D at or between slabs 66C and 66D in or of lane 54); and (b) the slab connection members 150 and 152 of the apparatus 100 are positioned at an area where another contraction joint will be formed and for connecting a set or pair of transversely adjacent concrete slabs in a lane (such as for the contraction joint between slabs 64C and 66C in or of lane 54).

It should further be appreciated from the above that in this illustrated example embodiment of present disclosure, each concrete slab load transfer and connection apparatus 100 is configured to be used or positioned such that: (a) the load transfer plates of that apparatus 100 are positioned for load transfer at areas where contraction joints will be formed between sets or pairs of longitudinally adjacent concrete slabs; and (b) the slab connection members 150 and 152 of the apparatus 100 are positioned at areas where additional contraction joints will be formed and for connecting sets or pairs of transversely adjacent concrete slabs. It should further be appreciated from the above that these sets or pairs can be overlapping as illustrated in FIG. 4.

It should further be appreciated from the above that after positioning the apparatus 100, after pouring the concrete, after saw cutting the contraction joints, and after the contraction joints have formed, the: (a) the load transfer plates of the apparatus 100 operate to transfer loads between sets or pairs of longitudinally adjacent concrete slabs (such as slabs 66C and 66D in or of lane 54); and (b) the slab connection members or slab connector 150 and 152 of the apparatus 100 operate to connect one or more sets or pairs of transversely adjacent concrete slabs in or of a lane (such as slab 64C and 66C in or of lane 54).

In this illustrated embodiment, (a) the load transfer plates are steel; (b) the basket is steel; and (c) the connection members or slab connectors are steel. It should be appreciated that one or more of these components can be made from other suitable materials in accordance with the present disclosure. It should also be appreciated that the connection members or slab connectors can have irregular or rough surfaces, can be deformed, or can otherwise be suitably configured to provide additional mechanical connection to the adjacent concrete slabs.

It should also be appreciated that one or more of: (a) the plurality of load transfer plates; (b) the basket; and/or (c) the plurality of slab connection members, can be made in other suitable sizes, shapes, and configurations in accordance with the present disclosure.

The present disclosure further provides a method of or for forming a roadway or a section of a roadway and or for employing a plurality of concrete slab load transfer and connection apparatus of the present disclosure such as apparatus 100. In various such embodiments, the method includes positioning each of a plurality of apparatus 100 on a grade or sub-surface to form part of a lane or section of a roadway such that: (a) the load transfer plates of that apparatus 100 are positioned for load transfer at the area where a contraction joint will be formed between a set or pair of longitudinally adjacent concrete slabs of the roadway (such as for contraction joint 76D to be formed at or between slabs 66C and 66D in or of lane 54); and (b) the slab connection members 150 and 152 of the apparatus 100 are positioned at the area where a contraction joint will be formed between a set or pair of transversely adjacent concrete slabs of the roadway (such as for the contraction joint 84C between slab 64C and 66C in lane 54).

In various such embodiments, the method further includes subsequently pouring the concrete to form the lane or section of the roadway (such as the section of the lane 54 of the roadway 10B shown in FIG. 4). In various such embodiments, the method subsequently includes allowing the poured concrete of the lane or section of the roadway to partially or fully set or cure. In various such embodiments, after the partial or full setting or curing of the concrete of the lane or section of the roadway, the method includes saw cutting the longitudinally extending contraction joints in the lane or section of the roadway along the appropriate longitudinal lines based on the positions of each of the apparatus 100 and specifically the positions of the various slab connection members 150 and 152 of each of the apparatus 100. In various such embodiments, after the partial or full setting or curing of the concrete of the lane or section of the roadway, the method also includes saw cutting the transversely extending contraction joints in the lane or section of the roadway along the appropriate transverse lines based on the positions of each of the apparatus 100 and specifically the positions of the load plates of each of the apparatus 100.

It should be appreciated that the transversely extend cuts will be made before the longitudinally extending cuts are made in various embodiments of the present disclosure.

This method of the present disclosure thus facilitates construction of a roadway or section of a roadway which includes one or more lanes, and wherein one or more of the lanes has transversely extending contraction joints and longitudinally extending contraction joints, and such that each concrete slab is sized such that only one wheel of a four wheeled vehicle (such as a truck) can be positioned on any one of the concrete slabs at any one time.

It should also be appreciated from the above and as specifically shown in FIG. 4, that the apparatus of the present disclosure is particularly suited for contraction joints for each set of four adjacent concrete slabs (e.g., 64C, 64D, 66C, and 66D) including first and second longitudinally adjacent concrete slabs (e.g., 64C and 64D) and third and fourth longitudinally adjacent slabs (e.g., 66C and 66D) where the first and third concrete slabs (e.g., 64C and 66C) are transversely adjacent concrete slabs and where the second and fourth concrete slabs (e.g., 64D and 66D) are transversely adjacent concrete slabs. It should also be appreciated that: (a) the first set of dowels or plates of the apparatus provide load transfer for the transversely extending contraction joint (e.g., 74D) between the first and second longitudinally adjacent concrete slabs (e.g., 64C and 64D); (b) the second set of dowels or plates of the apparatus provide load transfer for the transversely extending contraction joint (e.g., 76D) between the third and fourth longitudinally adjacent concrete slabs (e.g., 66C and 66D); (c) the first slab connection member of the apparatus provides connection between the longitudinally extending contraction joint (e.g., 84C) between the first and third transversely adjacent concrete slabs (e.g., 64C and 66C); and (d) the second slab connection member of the apparatus provides connection between the longitudinally extending contraction joint (e.g., 84D) between the second and fourth transversely adjacent concrete slabs (e.g., 64D and 66D).

$2^{nd}$ Example Embodiment

Figure 7:
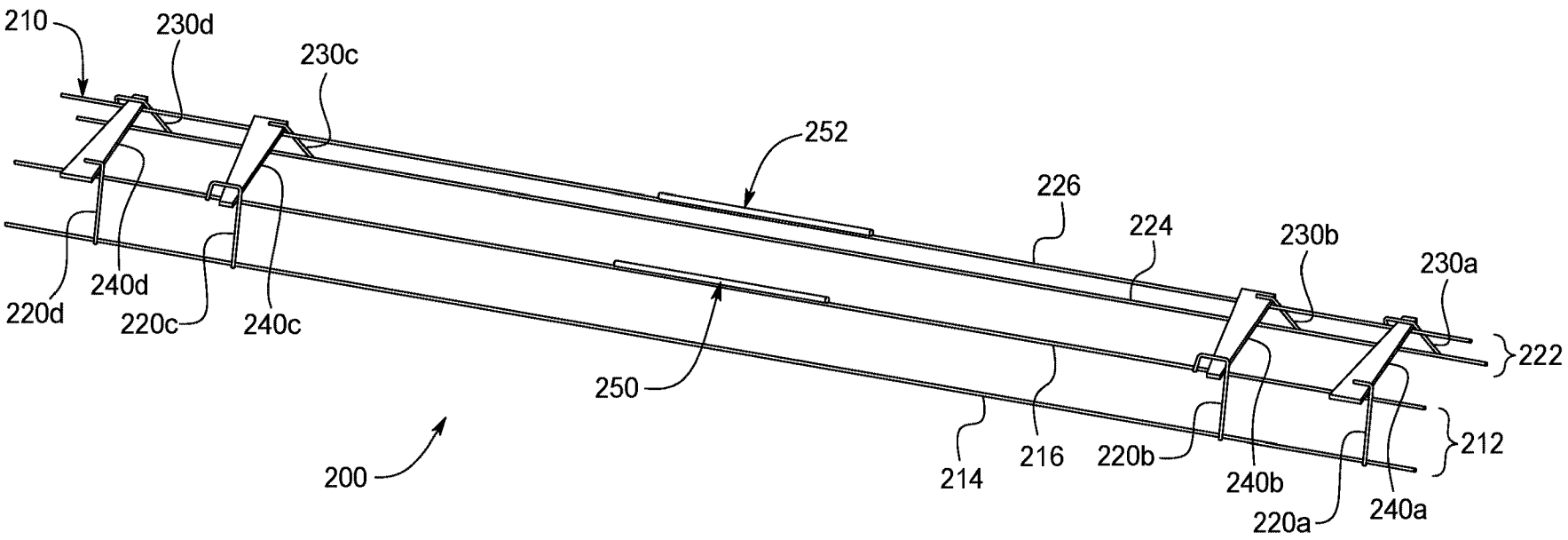
FIG. 7 is a perspective view of an alternative embodiment of the concrete slab load transfer and connection apparatus of the present disclosure.

Referring now to FIG. 7, another example embodiment of the concrete slab load transfer and connection apparatus of the present disclosure is generally indicated by numeral 200. The apparatus 200 is similar to apparatus 100 except in the form of the slab connection members.

More specifically, in the illustrated example embodiment of FIG. 7, this concrete slab load transfer and connection apparatus 200 generally includes: (a) a plurality of load transfer members such as load transfer dowels or plates 240*a*, 240*b*, 240*c*, and 240*d*; (b) a basket 210 configured to support the load transfer plates (such as load transfer plates 240*a*, 240*b*, 240*c*, and 240*d*); and (c) a plurality of slab connection members such as slab connection members 250 and 252.

The basket 210 in this illustrated example embodiment includes a first leg 212 and a spaced apart second leg 222. The first leg 212 includes a lower elongated member 214 and an upper elongated member 216. The first leg 212 further includes four dowel holding hands 220*a*, 220*b*, 220*c*, and 220*d*. Likewise, the second leg 222 includes a lower elongated member 224 and an upper elongated member 226. The second leg 222 further includes four dowel holding hands 230*a*, 230*b*, 230*c*, and 230*d*.

The first and second legs 212 and 222 co-act to hold and support a plurality of load transfer members, and particularly the load transfer dowels or plates 240*a* and 240*b*, at or along a transversely extending contraction joint will be formed.

The first and second legs 212 and 222 also co-act to hold and support a plurality of load transfer members, and particularly the load transfer dowels or plates 240*c* and 240*d*, at or along an area where a transversely extending contraction joint will be formed.

The tapered load transfer plates 240*a*, 240*b*, 240*c*, and 240*d* are supported by the basket 210 and specifically supported by the first leg 212 and the second leg 222 in opposing fashion in this illustrated example embodiment.

The plurality of slab connection members 250 and 252 of the concrete slab load transfer and connection apparatus 200 of this illustrated example embodiment in FIG. 7, are respectively integrally connected to the legs 212 and 222 of the basket 210. More specifically, the slab connection member 250 includes an elongated generally cylindrical rod having two opposing ends. The slab connection member 250 is integrally connected to the upper elongated member 216 of the basket 210. Likewise, the slab connection member 252 is an elongated generally cylindrical rod having two opposing ends. The slab connection member 252 is integrally connected to the upper elongated member 226 of the basket 210. The slab connection members 250 and 252 are made from rebar in certain embodiments and have suitable surfaces that increase the surface area engagement between such connection members and the concrete slabs. It should also be appreciated that the legs 212 and 222 of the basket 210 and the components thereof act to secure the apparatus 200 in the respective adjacent concrete slabs (such as the transversely adjacent concrete slabs).

It should thus be appreciated from the above that in this illustrated example embodiment of present disclosure, each concrete slab load transfer and connection apparatus 200 is configured to be used or positioned such that: (a) the load transfer plates of that apparatus 200 are positioned for load transfer at an area where a contraction joint will formed between a set or pair of longitudinally adjacent concrete slabs; and (b) the slab connection members 250 and 252 of the apparatus 200 are positioned at an area where a contraction joint that will be formed and for connecting a set or pair of transversely adjacent concrete slabs.

It should also thus be appreciated from the above that in this illustrated example embodiment of present disclosure, each concrete slab load transfer and connection apparatus 200 is configured to be used or positioned such that: (a) the load transfer plates of that apparatus 200 are positioned for load transfer at areas where contraction joints will formed between sets or pairs of longitudinally adjacent concrete slabs; and (b) the slab connection members 250 and 252 of the apparatus 200 are positioned at areas where additional contraction joints will be formed and for connecting sets or pairs of transversely adjacent concrete slabs.

It should further thus be appreciated from the above that after positioning the apparatus 200, after pouring the concrete, after saw cutting the contraction joints, and after the contraction joints have formed, the: (a) the load transfer plates of that apparatus 200 can operate to transfer loads between a set or pair of longitudinally adjacent concrete slabs; and (b) the slab connection members 250 and 252 of the apparatus 200 can operate to connect a set or pair of transversely adjacent concrete slabs.

In this illustrated embodiment, (a) the load transfer plates are steel; (b) the basket is steel; and (c) the connection members or slab connectors are steel. It should be appreciated that one or more of these components can be made from other suitable materials in accordance with the present disclosure. It should also be appreciated that the connection members or slab connectors can have irregular or rough surfaces, can be deformed, or can otherwise be suitably configured to provide additional mechanical connection to the adjacent concrete slabs.

It should also be appreciated that one or more of: (a) the plurality of load transfer plates; (b) the basket; and/or (c) the plurality of slab connection members, can be made in other suitable sizes, shapes, and configurations in accordance with the present disclosure.

The present disclosure further provides a method of or for forming a roadway or section of a roadway and or for employing a plurality of concrete slab load transfer and connection apparatus 200. In various such embodiments, the method includes positioning each of a plurality of apparatus 200 on a grade or sub-surface to form a lane or section of a roadway such that: (a) the load transfer plates of that apparatus 200 are positioned for load transfer at an area where a contraction joint is to be formed between a set or pair of longitudinally adjacent concrete slabs of a lane or section of the roadway; and (b) the slab connection members 250 and 252 of the apparatus 200 are positioned at an area where a contraction joint is to be formed between a set or pair of transversely adjacent concrete slabs in the lane or section of the roadway.

In various such embodiments, the method further includes subsequently pouring the concrete to form the lane or section of the roadway. In various such embodiments, the method subsequently includes allowing the pouring concrete of the lane or section of the roadway to partially or fully set or cure. In various such embodiments, after the partial or full setting or curing of the concrete of the lane or section of the roadway, the method includes saw cutting the longitudinally extending contraction joints in the lane or section of the roadway along the appropriate longitudinal lines based on the positions of each of the apparatus 200 and specifically the positions of the slab connection members 250 and 252 of each of the apparatus 200. In various such embodiments, after the partial or full setting or curing of the concrete of the lane or section of the roadway, the method also includes saw cutting the transversely extending contraction joints in the lane or section of the roadway along the appropriate transverse lines based on the positions of each of the apparatus 200 and specifically the positions of the load plates 240*a*, 240*b*, 240*c*, and 240*d* of each of the apparatus 200.

This method of the present disclosure thus facilitates construction of a roadway or section of a roadway which includes one or more lanes, and wherein for one or more of the lanes has transversely extending contraction joints and longitudinally extending contraction joints, and such that each concrete slab is sized such that only one wheel of a four wheeled vehicle (such as a truck) can be positioned on any one of the concrete slabs at any one time.

3$^{rd}$ Example Embodiment

Figure 8:
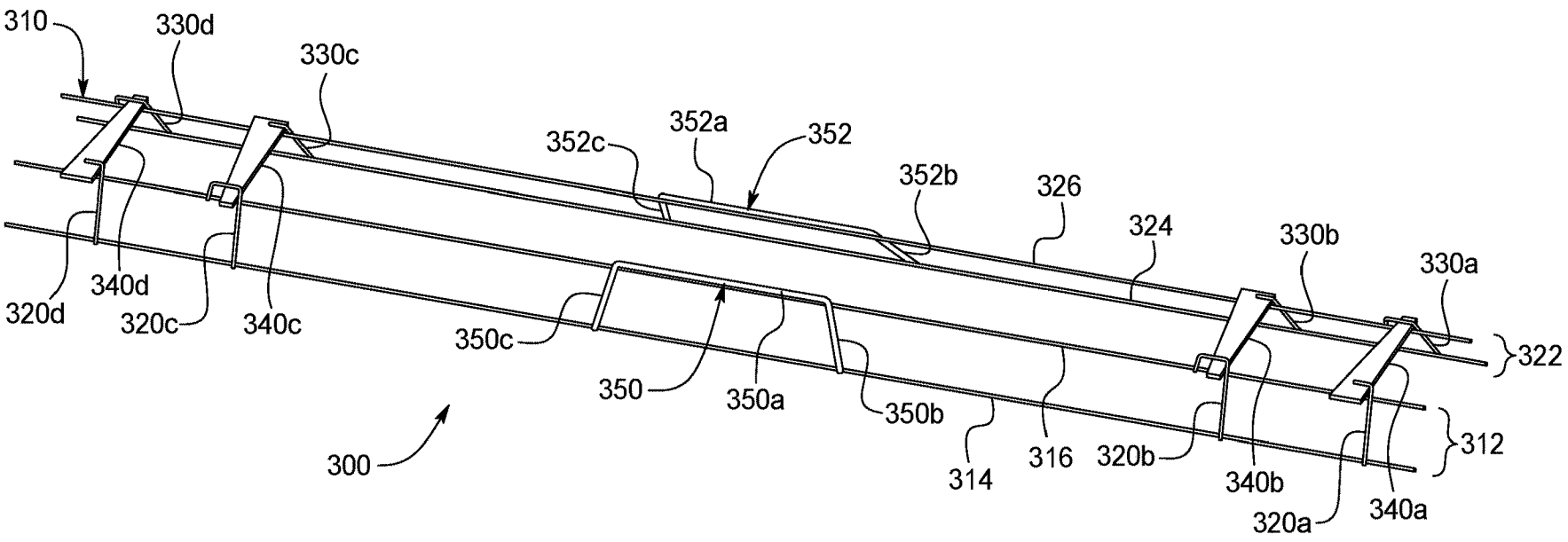
FIG. 8 is a perspective view of a further alternative embodiment of the concrete slab load transfer and connection apparatus of the present disclosure.

Referring now to FIG. 8, another example embodiment of the concrete slab load transfer and connection apparatus of the present disclosure is generally indicated by numeral 300. The apparatus 300 is similar to apparatus 100 except in the form of the slab connection members More specifically, in the illustrated embodiment of FIG. 8, this concrete slab load transfer and connection apparatus 300 generally includes: (a) a plurality of load transfer members such as load transfer dowels or plates 340*a*, 340*b*, 340*c*, and 340*d*; (b) a basket 310 configured to support the load transfer plates (such as load transfer plates 340*a*, 340*b*, 340*c*, and 340*d*); and (c) a plurality of slab connection members such as slab connection members 350 and 352.

The basket 310 in this illustrated example embodiment includes a first leg 312 and a spaced apart second leg 322. The first leg 312 includes a lower elongated member 314 and an upper elongated member 316. The first leg 312 further includes four dowel holding hands 320*a*, 320*b*, 320*c*, and 320*d*. Likewise, the second leg 322 includes a lower elongated member 324 and a first upper elongated member 326. The second leg 322 further includes four dowel holding hands 330*a*, 330*b*, 330*c*, and 330*d*.

The first and second legs 312 and 322 co-act to hold and support a plurality of load transfer members, and particularly the load transfer dowels or plates 340*a* and 340*b*, at or along an area where a transversely extending contraction joint will be formed.

The first and second legs 312 and 322 also co-act to hold and support a plurality of load transfer members, and particularly the load transfer dowels or plates 340*c* and 340*d*, at or along an area where a transversely extending contraction joint will be formed.

The tapered load transfer plates 340*a*, 340*b*, 340*c*, and 340*d*, are supported by the basket 310 and specifically supported by the first leg 312 and the second leg 322 in opposing fashion in this illustrated example embodiment.

The plurality of slab connection members or slab connectors 350 and 352 of the concrete slab load transfer and connection apparatus 300 of this illustrated example embodiment in FIG. 8, are respectively integrally connected to the legs 312 and 322 of the basket 310. More specifically, the slab connection member 350 includes a generally upside down U-shaped elongated generally cylindrical rod having two opposing ends. The slab connector 350 includes an elongated body 350*a* and spaced apart downwardly extending legs 350*b* and 350*c*. The body 350*a* is integrally connected to the upper elongated member 316 of the basket 310. The legs 350*b* and 350*c* are integrally connected to the upper elongated member 316 and the lower elongated member 314. Likewise, the slab connection member 352 includes an elongated generally cylindrical rod having two opposing ends. The slab connector 352 includes an elongated body 352*a* and spaced apart downwardly extending legs 352*b* and 352*c*. The body is integrally connected to the upper elongated member 326 of the basket 310. The legs 352*b* and 352*c* are integrally connected to the upper elongated member 326 and the lower elongated member 324. The slab connection members 350 and 352 are made from rebar in certain embodiments and have suitable surfaces that increase the surface area engagement between such connection members and the concrete slabs. It should also be appreciated that the legs 312 and 322 of the basket 310 and the components thereof act to secure the apparatus 300 in the respective adjacent concrete slabs (such as the transversely adjacent concrete slabs).

It should thus be appreciated from the above that in this illustrated example embodiment of present disclosure, each concrete slab load transfer and connection apparatus 300 is configured to be used or positioned such that: (a) the load transfer plates of that apparatus 300 are positioned for load transfer at an area where a contraction joint will be formed between a set or pair of longitudinally adjacent concrete slabs; and (b) the slab connection members 350 and 352 of the apparatus 300 are positioned at an area where a contraction joint will be formed and for connecting a set or pair of transversely adjacent concrete slabs.

It should also be appreciated from the above that in this illustrated example embodiment of present disclosure, each concrete slab load transfer and connection apparatus 300 is configured to be used or positioned such that: (a) the load transfer plates of that apparatus 300 are positioned for load transfer at areas where contraction joints will be formed between sets or pairs of longitudinally adjacent concrete slabs; and (b) the slab connection members 350 and 352 of the apparatus 300 are positioned at areas where additional contraction joints will be formed and for connecting sets or pairs of transversely adjacent concrete slabs.

It should further thus be appreciated from the above that after positioning the apparatus 300, after pouring the concrete, after saw cutting the contraction joints, and after the contraction joints have formed, the (a) the load transfer plates of that apparatus 300 can operate to transfer loads between a set or pair of longitudinally adjacent concrete slabs; and (b) the slab connection members 350 and 352 of the apparatus 300 can operate to connect a set or pair of transversely adjacent concrete slabs.

In this illustrated embodiment, (a) the load transfer plates are steel; (b) the basket is steel; and (c) the connection members or slab connectors are steel. It should be appreciated that one or more of these components can be made from other suitable materials in accordance with the present disclosure. It should also be appreciated that the connection members or slab connectors can have irregular or rough surfaces, can be deformed, or can otherwise be suitably configured to provide additional mechanical connection to the adjacent concrete slabs.

It should also be appreciated that one or more of: (a) the plurality of load transfer plates; (b) the basket; and/or (c) the plurality of slab connection members, can be made in other suitable sizes, shapes, and configurations in accordance with the present disclosure.

The present disclosure further provides a method of or for forming a roadway or section of a roadway and or for employing a plurality of concrete slab load transfer and connection apparatus 300. In various such embodiments, the method includes positioning each of a plurality of apparatus 300 on a grade or sub-surface to form a lane or section of a roadway such that: (a) the load transfer plates of that apparatus 300 are positioned for load transfer at an area where a contraction joint is to be formed between a set or pair of longitudinally adjacent concrete slabs of a lane or section of the roadway; and (b) the slab connection members 350 and 352 of the apparatus 300 are positioned at an area where the contraction joint is to be formed between a set or pair of transversely adjacent concrete slabs in the lane or section of the roadway.

In various such embodiments, the method further includes subsequently pouring the concrete to form the lane of the roadway or section of the roadway. In various such embodiments, the method subsequently includes allowing the poured concrete of the lane or section of the roadway to partially or fully set or cure. In various such embodiments, after the partial or full setting or curing of the concrete of the lane or section of the roadway, the method includes saw cutting the longitudinally extending contraction joints in the lane or section of the roadway along the appropriate longitudinal lines based on the positions of each of the apparatus 300 and specifically the positions of the slab connection members 350 and 352 of each of the apparatus 300. In various such embodiments, after the partial or full setting or curing of the concrete of the lane or section of the roadway, the method also includes saw cutting the transversely extending contraction joints in the lane or section of the roadway along the appropriate transverse lines based on the positions of each of the apparatus 300 and specifically the positions of the load plates 340*a*, 340*b*, 340*c*, and 340*d* of each of the apparatus 300.

This method of the present disclosure thus facilitates construction of a roadway or section of a roadway which includes one or more lanes, and wherein one or more of the lanes has transversely extending contraction joints and longitudinally extending contraction joints, and such that each concrete slab is sized such that only one wheel of a four wheeled vehicle (such as a truck) can be positioned on any one of the concrete slabs at any one time.

$4^{th}$ Example Embodiment

Figure 9:
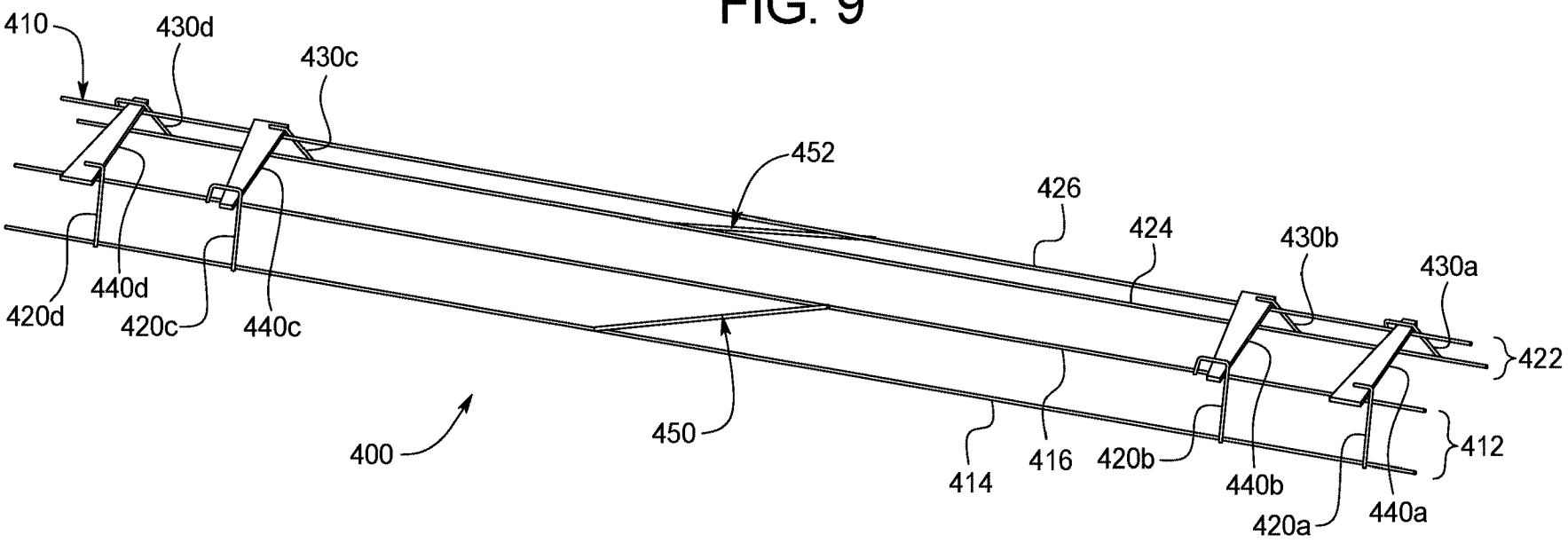
FIG. 9 is a perspective view of a further alternative embodiment of the concrete slab load transfer and connection apparatus of the present disclosure.

Referring now to FIG. 9, another example embodiment of the concrete slab load transfer and connection apparatus of the present disclosure is generally indicated by numeral 400. The apparatus 400 is similar to apparatus 100 except in the form of the slab connection members.

More specifically, in the illustrated embodiment of FIG. 9, this concrete slab load transfer and connection apparatus 400 generally includes: (a) a plurality of load transfer members such as load transfer dowels or plates 440*a*, 440*b*, 440*c*, and 440*d*; (b) a basket 410 configured to support the load transfer plates (such as load transfer plates 440*a*, 440*b*, 440*c*, and 440*d*); and (c) a plurality of slab connection members such as slab connection members 450 and 452.

The basket 410 in this illustrated example embodiment includes a first leg 412 and a spaced apart second leg 422. The first leg 412 includes a lower elongated member 414 and an upper elongated member 416. The first leg 412 further includes four dowel holding hands 420*a*, 420*b*, 420*c*, and 420*d*. Likewise, the second leg 422 includes a lower elongated member 424 and an upper elongated member 426. The second leg 422 further includes four dowel holding hands 430*a*, 430*b*, 430*c*, and 430*d*.

The first and second legs 412 and 422 co-act to hold and support a plurality of load transfer members, and particularly the load transfer dowels or plates 440*a* and 440*b*, at or along an area where a transversely extending contraction joint will be formed.

The first and second legs 412 and 422 also co-act to hold and support a plurality of load transfer members, and particularly the load transfer dowels or plates 440*c* and 440*d*, at or along an area where a transversely extending contraction joint will be formed.

The tapered load transfer plates 440*a*, 440*b*, 440*c*, and 440*d* are supported by the basket 410 and specifically supported by the first leg 412 and the second leg 422 in opposing fashion in this illustrated example embodiment.

The plurality of slab connection members or slab connectors 450 and 452 of the concrete slab load transfer and connection apparatus 400 of this illustrated example embodiment in FIG. 9 are respectively integrally connected to the legs 412 and 422 of the basket 410. More specifically, the slab connection member 450 includes an elongated generally cylindrical rod having two opposing ends. A first one of the ends is integrally connected to the lower elongated member 414 and a second one of the ends is integrally connected to the upper elongated member 416. Likewise, the slab connection member 452 includes an elongated generally cylindrical rod having two opposing ends. A first one of the ends is integrally connected to the lower elongated member 424 and a second one of the ends is integrally connected to the upper elongated member 426. The slab connection members 450 and 452 are made from rebar in certain embodiments and have suitable surfaces that increase the surface area engagement between such connection members and the concrete slabs. It should also be appreciated that the legs 412 and 422 of the basket 410 and the components thereof act to secure the apparatus 400 in the respective adjacent concrete slabs (such as the transversely adjacent concrete slabs).

It should thus be appreciated from the above that in this illustrated example embodiment of present disclosure, each concrete slab load transfer and connection apparatus 400 is configured to be used or positioned such that: (a) the load transfer plates of that apparatus 400 are positioned for load transfer at an area where a contraction joint will be formed between a set or pair of longitudinally adjacent concrete slabs; and (b) the slab connection members 450 and 452 of the apparatus 400 are positioned at an area where a contraction joint will be formed and for connecting a set or pair of transversely adjacent concrete slabs.

It should further be appreciated from the above that in this illustrated example embodiment of present disclosure, each concrete slab load transfer and connection apparatus 400 is configured to be used or positioned such that: (a) the load transfer plates of that apparatus 400 are positioned for load transfer at areas where contraction joints will be formed between sets or pairs of longitudinally adjacent concrete slabs; and (b) the slab connection members 450 and 452 of the apparatus 400 are positioned at areas where additional contraction joints will be formed and for connecting sets or pairs of transversely adjacent concrete slabs.

It should further thus be appreciated from the above that after positioning the apparatus 400, after pouring the concrete, after saw cutting the contraction joints, and after the contraction joints have formed, the (a) the load transfer plates of that apparatus 400 can operate to transfer loads between a set or pair of longitudinally adjacent concrete slabs; and (b) the slab connection members 450 and 452 of the apparatus 400 can operate to connect a set or pair of transversely adjacent concrete slabs.

In this illustrated embodiment, (a) the load transfer plates are steel; (b) the basket is steel; and (c) the connection members or slab connectors are steel. It should be appreciated that one or more of these components can be made from other suitable materials in accordance with the present disclosure. It should also be appreciated that the connection members or slab connectors can have irregular or rough surfaces, can be deformed, or can otherwise be suitably configured to provide additional mechanical connection to the adjacent concrete slabs.

It should also be appreciated that one or more of: (a) the plurality of load transfer plates; (b) the basket; and/or (c) the plurality of slab connection members, can be made in other suitable sizes, shapes, and configurations in accordance with the present disclosure.

The present disclosure further provides a method of or for forming a roadway or section of a roadway and or for employing a plurality of concrete slab load transfer and connection apparatus 400. In various such embodiments, the method includes positioning each of a plurality of apparatus 400 on a grade or sub-surface to form a lane or section of a roadway such that: (a) the load transfer plates of that apparatus 400 are positioned for load transfer at an area where a contraction joint is to be formed between a set or pair of longitudinally adjacent concrete slabs of a lane or section of the roadway; and (b) the slab connection members 450 and 452 of the apparatus 400 are positioned at an area where a contraction joint is to be formed between a set or pair of transversely adjacent concrete slabs in the lane or section of the roadway.

In various such embodiments, the method further includes subsequently pouring the concrete to form the lane of the roadway. In various such embodiments, the method subsequently includes allowing the poured concrete of the lane or section of the roadway to partially or fully set or cure. In various such embodiments, after the partial or full setting or curing of the concrete of the lane or section of the roadway, the method includes saw cutting the longitudinally extending contraction joints in the lane or section of the roadway along the appropriate longitudinal lines based on the positions of each of the apparatus 400 and specifically the positions of the slab connection members 450 and 452 of each of the apparatus 400. In various such embodiments, after the partial or full setting or curing of the concrete of the lane or section of the roadway, the method also includes saw cutting the transversely extending contraction joints in the lane or section of the roadway along the appropriate transverse lines based on the positions of each of the apparatus 400 and specifically the positions of the load plates 440*a*, 440*b*, 440*c*, and 440*d* of each of the apparatus 400.

This method of the present disclosure thus facilitates construction of a roadway or section of a roadway which includes one or more lanes, and wherein for one or more of the lanes has transversely extending contraction joints and longitudinally extending contraction joints, and such that each concrete slab is sized such that only one wheel of a four wheeled vehicle (such as a truck) can be positioned on any one of the concrete slabs at any one time.

$5^{th}$ Example Embodiment

Figure 10:
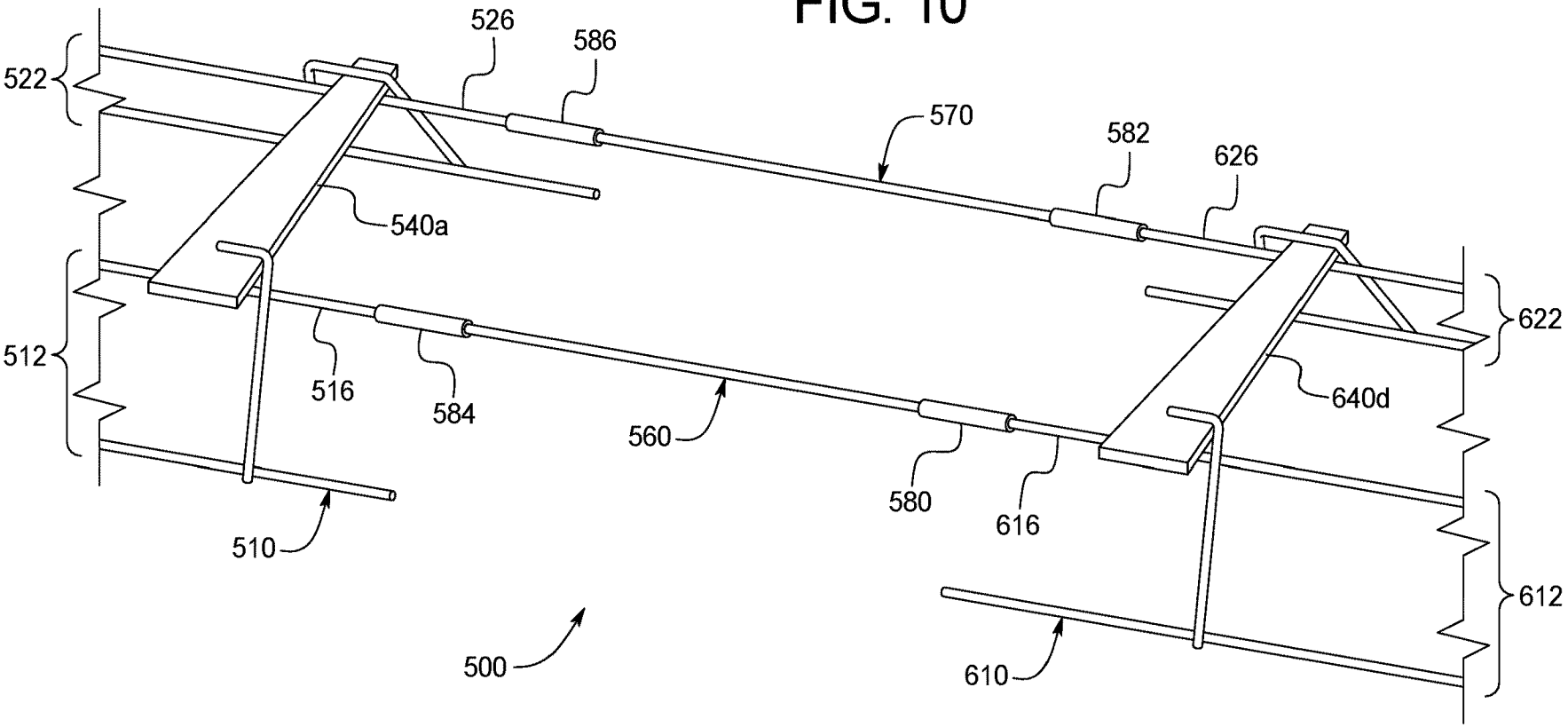
FIG. 10 is a perspective view of a further alternative embodiment of the concrete slab load transfer and connection apparatus of the present disclosure.
Figure 11:
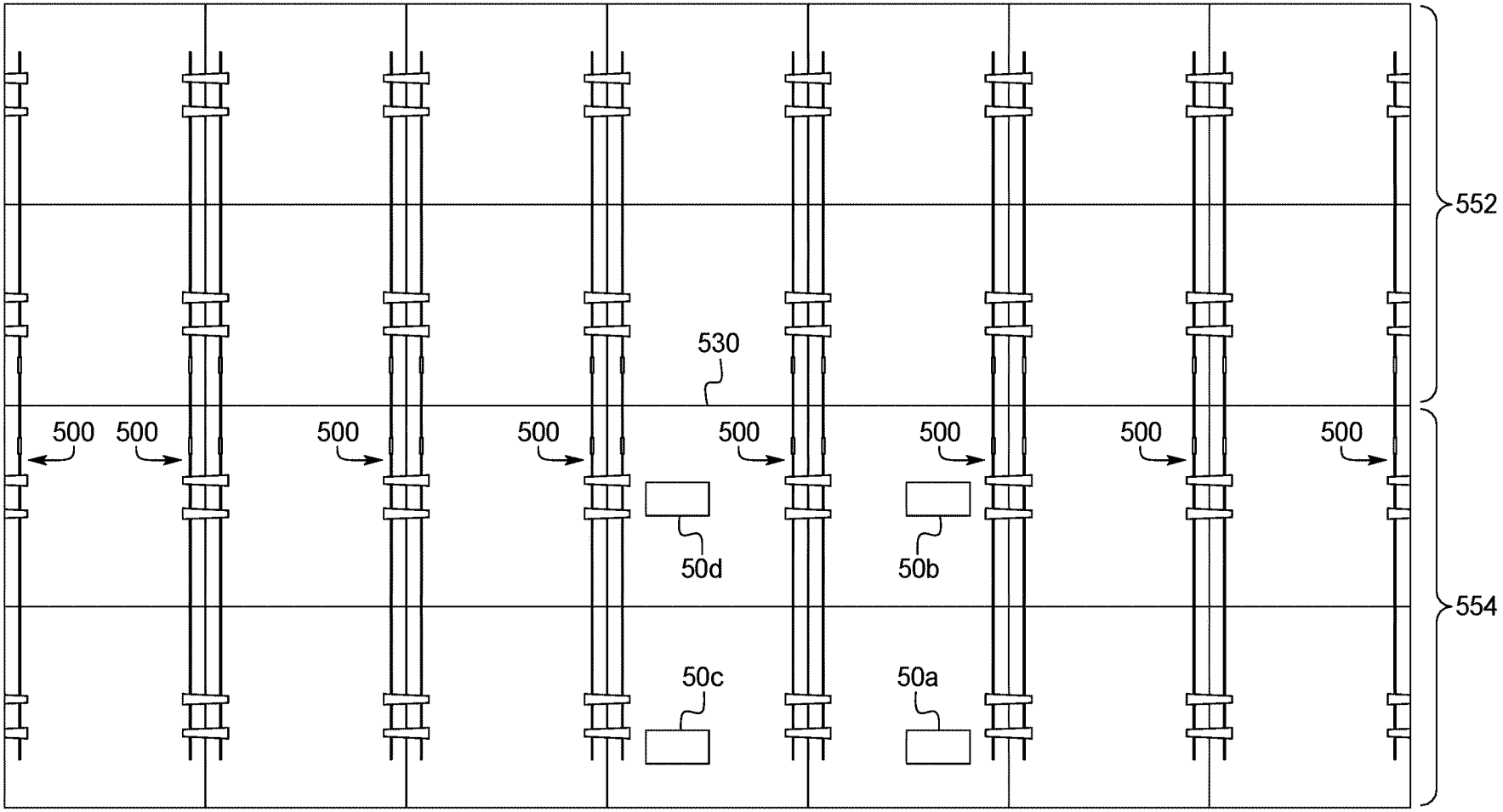
FIG. 11 is a top diagramatic view of a section of roadway constructed with the concrete slab load transfer and connection apparatus of FIG. 10.

Referring now to FIGS. 10 and 11, another example embodiment of the concrete slab load transfer and connection apparatus of the present disclosure is generally indicated by numeral 500. This apparatus 500 is somewhat similar to apparatus 100, except that it employs a plurality of (such as two) baskets (which can be any of the baskets 110, 210, 310, or 410 in various embodiments). In other words, the illustrated example embodiment of FIGS. 10 and 11 can in certain embodiments include any two of concrete slab load transfer and connection apparatus such as any of apparatus 100, 200, 300, or 400.

More specifically, this illustrated slab load transfer and connection apparatus 500 generally includes two baskets 510 and 610 each configured to respectively support a plurality of load transfer members (such as illustrated load transfer plates 540*a* and 640*d*). This apparatus 500 also include a plurality of slab connection members such as slab connection members 560 and 570, and a plurality of basket linkage members or basket linkers 580, 582, 584, and 586.

The plurality of slab connection members 560 and 570 of the concrete slab load transfer and connection apparatus 500 of this illustrated example embodiment in FIGS. 10 and 11, are respectively attached to the legs 512 and 522 of the basket 510 and the legs 612 and 622 of the basket 610. More specifically, the slab connection member 560 includes an elongated generally cylindrical rod having two opposing ends respectively connected to the upper elongated member 516 of the basket 510 and the upper elongated member 616 of the basket 610. Likewise, the slab connection member 570 includes an elongated generally cylindrical rod having two opposing ends respectively connected to the upper elongated member 526 of the basket 510 and the upper elongated member 626 of the basket 610. The slab connection members 560 and 570 are made from rebar in certain embodiments and have suitable surfaces that increase the surface area engagement between such connection members and the concrete slabs. It should also be appreciated that the legs of the baskets and the components thereof can act to secure the apparatus in the respective adjacent concrete slabs (such as the transversely adjacent concrete slabs).

These example plurality of basket linkage members or basket linkers 580, 582, 584, and 586 are tubular sleeves in this illustrated embodiment configured to fit around the respective ends of the baskets and the slab connection members 560 and 570, and thus removably connect such components. More specifically, (a) basket linkage member or basket linker 580 is configured to link or connect one end of the slab connection member 560 to the basket 610 and specifically to elongated member 616; and (b) basket linkage member or basket linker 584 is configured to link or connect the opposite end of the slab connection member 560 to the basket 510 and specifically to elongated member 516. Likewise, (a) basket linkage member or basket linker 582 is configured to link or connect one end of the slab connection member 570 to the basket 610 and specifically to elongated member 626; and (b) basket linkage member or basket linker 586 is configured to link or connect the opposite end of the slab connection member 570 to the basket 510 and specifically to elongated member 526.

It should be appreciated from the above that in this example embodiment of present disclosure, each concrete slab load transfer and connection apparatus 500 is configured to be used or positioned such that: (a) the load transfer plates of that apparatus 500 are positioned for load transfer at an area where a contraction joint will be formed between a set or pair of longitudinally adjacent concrete slabs; and (b) the slab connection members 560 and 570 of the apparatus 500 are positioned for slab connection at an area where another contraction joint (such as contraction joint 530) will be formed for connecting a set or pair of transversely adjacent concrete slabs such as for adjacent lanes (such as lanes 552 and 554) of a section of a roadway 10C as shown in FIG. 11.

It should further be appreciated from the above that after positioning the various apparatuses 500, after pouring the concrete, after saw cutting the contraction joints, and after the contraction joints have formed: (a) the load transfer plates of that apparatus 500 operate to transfer loads between a set or pair of longitudinally adjacent concrete slabs; and (b) the slab connection members 560 and 570 of the apparatus 500 operate to connect a set or pair of transversely adjacent concrete slabs at a construction joint.

In this illustrated embodiment: (a) the load transfer plates are steel; (b) the basket is steel; and (c) the connection members or slab connectors are steel. It should be appreciated that one or more of these components can be made from other suitable materials in accordance with the present disclosure. It should also be appreciated that the connection members or slab connectors can have irregular or rough surfaces, can be deformed, or can otherwise be suitably configured to provide additional mechanical connection to the adjacent concrete slabs.

It should also be appreciated that one or more of: (a) the plurality of load transfer plates; (b) the basket; and/or (c) the plurality of slab connection members, can be made in other suitable sizes, shapes, and configurations in accordance with the present disclosure.

The present disclosure further provides a method of or for forming a roadway or section of a roadway and or for employing a plurality of concrete slab load transfer and connection apparatus 500. In various such embodiments, the method includes positioning each of a plurality of apparatus 500 on a grade or sub-surface to form a plurality of lanes or sections of a roadway such that: (a) the load transfer members or plates of that apparatus 500 are positioned for load transfer at the area where a contraction joint is to be formed between a set or pair of longitudinally adjacent concrete slabs of the roadway or section of the roadway; and (b) the slab connection members 560 and 570 of the apparatus 500 are positioned at another contraction joint to be formed between a set or pair of transversely adjacent concrete slabs of the roadway or section of the roadway. This method may employ an of the methods and apparatus explained above.

In various such embodiments, the method further includes subsequently pouring the concrete to form the roadway or section of the roadway. In various such embodiments, the method subsequently includes allowing the poured concrete of the roadway or section of the roadway to partially or fully set or cure. In various such embodiments, after the partial or full setting or curing of the concrete of the roadway or section of the roadway, the method includes saw cutting the transversely and longitudinally extending contraction joints the roadway or section of the roadway along the appropriate longitudinal lines based on the positions of each of the apparatus 500 and specifically the positions of the slab connection members 560 and 570 of each of the apparatus 500. In various such embodiments, after the partial or full setting or curing of the concrete of the roadway or section of the roadway, the method also includes saw cutting the transversely extending contraction joints in the lane of the roadway or section of the roadway along the appropriate transverse lines based on the positions of each of the apparatus 500 and specifically the positions of the load plates of each of the apparatus 500.

This method of the present disclosure thus facilitates construction of a roadway or section of a roadway which includes one or more lanes, and wherein for one or more of the lanes has transversely extending contraction joints and longitudinally extending contraction joints, and such that each concrete slab is sized such that only one wheel of a four wheeled vehicle (such as a truck) is position on any one of the concrete slabs at any one time.

$6^{th}$ Example Embodiment

Figure 12:
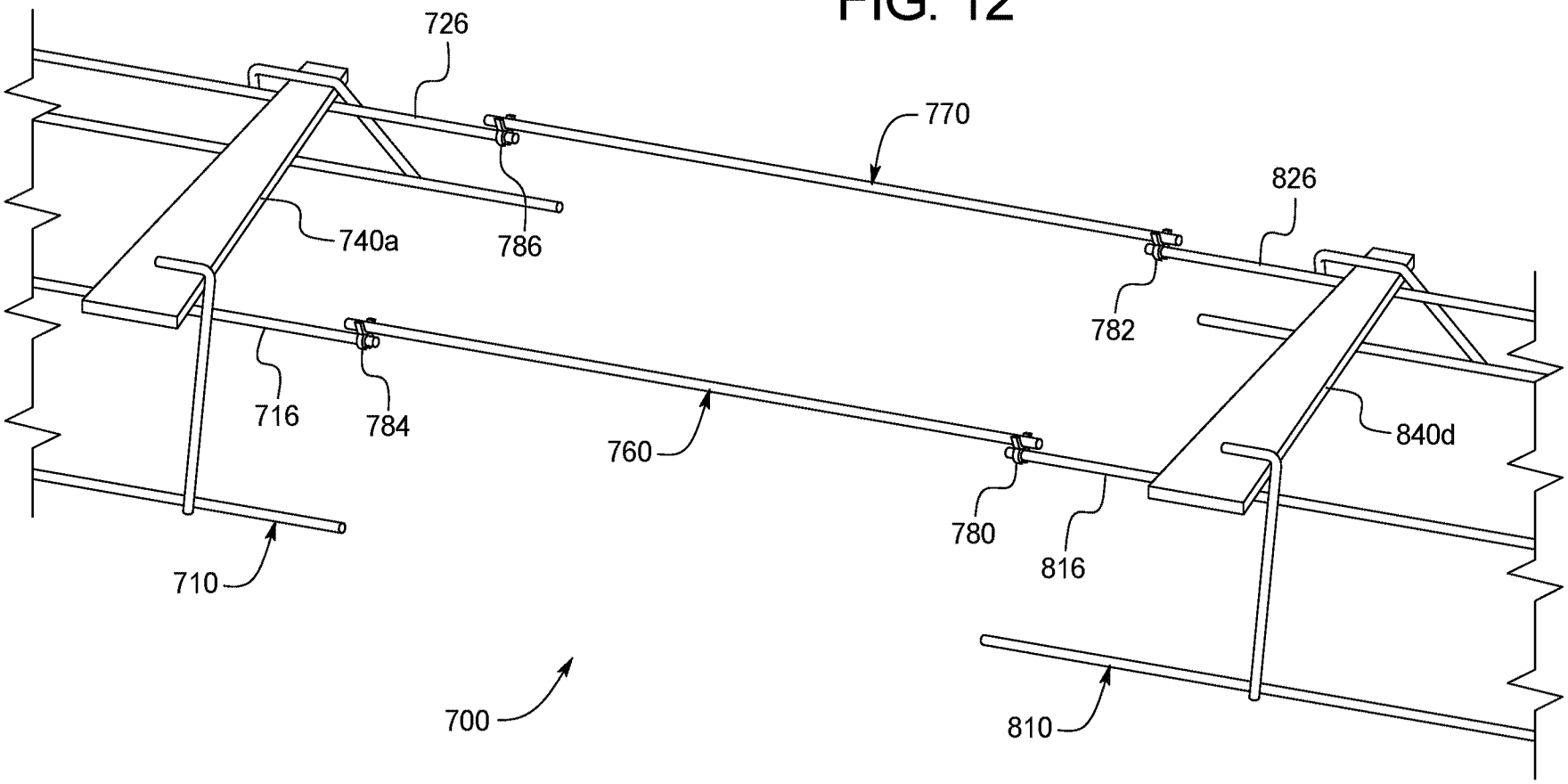
FIG. 12 is a perspective view of a further alternative embodiment of the concrete slab load transfer and connection apparatus of the present disclosure.

Referring now to FIG. 12, another one example embodiment of the concrete slab load transfer and connection apparatus of the present disclosure is generally indicated by numeral 700. This apparatus is similar to the apparatus 500, except that the basket linkage members or basket linkers 780, 782, 784, and 786 are different. In other words, the illustrated example embodiment of FIG. 12 can in various embodiments includes any two of concrete slab load transfer and connection apparatus of the present disclosure such as apparatus 100, 200, 300, or 400.

More specifically, this example slab load transfer and connection apparatus 700 generally includes two baskets 710 and 810 configured to respectively support a plurality of load transfer members such as load transfer plates 740*a* and 840*d*, and also including a plurality of slab connection members such as slab connection members 760 and 770, and basket linkage members or basket linkers 780, 782, 784, and 786.

These alternative basket linkage members or basket linkers 780, 782, 784, and 786 include a tubular ring configured to fit around the respective ends of the baskets and upwardly extending supporting arms that define a slot for receiving the slab connection members 760 and 770, and thus removably connect such components. More specifically, (a) basket linkage member or basket linker 780 is configured to link or connect one end of the slab connection member 760 to the basket 710 and specifically to elongated member 716; and (b) basket linkage member or basket linker 784 is configured to link or connect the opposite end of the slab connection member 760 to the basket 710 and specifically to elongated member 716. Likewise, (a) basket linkage member or basket linker 782 is configured to link or connect one end of the slab connection member 770 to the basket 810 and specifically to elongated member 826; and (b) basket linkage member or basket linker 786 is configured to link or connect the opposite end of the slab connection member 770 to the basket 710 and specifically to elongated member 726. It should be appreciated that the extending supporting arms could alternatively extend in other directions besides upwardly.

Thus, this illustrated embodiment performs in the same manner and can be used in the same methods as the embodiment of FIGS. 10 and 11.

It should be appreciated from the above example embodiments, that the present disclosure contemplates an apparatus for employing certain parts of a basket (configured to support dowels for one or more contraction joints) as the slab connection members for a contraction joint at or between adjacent concrete slabs. Likewise, it should be appreciated from the above example embodiments, that the present disclosure contemplates a method of using such a basket such that the slab connection members are positioned in the area where a contraction joint will be formed at or between adjacent concrete slabs.

It should further be appreciated from the above example embodiments, that the present disclosure contemplates employing slab connection members attached to certain parts of a basket (configured to support dowels for one or more contraction joints) for a contraction joint at or between adjacent concrete slabs. Likewise, it should be appreciated from the above example embodiments, that the present disclosure contemplates a method of using such a basket such that the slab connection members are positioned in the area where a contraction joint will be formed at or between adjacent concrete slabs.

It should further be appreciated from the above example embodiments, that the present disclosure contemplates employing slab connection members attached to multiple baskets for a contraction joint at or between adjacent concrete slabs. Likewise, it should be appreciated from the above example embodiments, that the present disclosure contemplates a method of using such baskets such that the slab connection members are positioned in the area where a contraction joint will be formed at or between adjacent concrete slabs.

It should further be appreciated from the above that the present disclosure provides in certain embodiments a concrete slab load transfer and connection apparatus including a plurality of load transfer dowels, a basket supporting the load transfer dowels, and a plurality of slab connection members forming part of or connected to the basket.

In certain such embodiments, a plurality of the load transfer dowels are positionable at a first contraction joint between and configured for load transfer between a first pair of adjacent concrete slabs.

In certain such embodiments, a plurality of the load transfer dowels are positionable at a second contraction joint between and for connecting a second pair of adjacent concrete slabs.

In certain such embodiments, one of the slab connection members is positionable at a third contraction joint between and for connecting one of the first pair of adjacent concrete slabs and one of the second pair of adjacent concrete slabs.

In certain such embodiments, the first pair of adjacent concrete slabs are longitudinally adjacent concrete slabs in a roadway or a floor, and the second pair of adjacent concrete slabs are longitudinally adjacent concrete slabs in the roadway or the floor.

It should further be appreciated from the above that the present disclosure provides in certain embodiments concrete slab load transfer and connection apparatus including a plurality of load transfer dowels, a plurality of baskets supporting the load transfer dowels, and a plurality of slab connection members connecting the plurality of baskets.

In certain such embodiments, one of the slab connection members is positionable at a contraction joint between and for connecting adjacent concrete slabs.

In certain such embodiments, the load transfer dowels are positionable at first and second contraction joints.

In certain such embodiments, the slab connection members are positionable at third and fourth contraction joints.

In certain such embodiments, the first and second contraction joints extend transversely in a roadway or a floor, and the third and fourth contraction joints extend longitudinally adjacent concrete slabs in the roadway or the floor.

It should further be appreciated from the above that the present disclosure provides in certain embodiments a method of forming a section of a roadway or floor, wherein the method includes positioning a concrete slab load transfer and connection apparatus on a sub-grade, said concrete slab load transfer and connection apparatus including: (i) a plurality of load transfer dowels, (ii) a basket supporting the load transfer dowels, and (iii) a plurality of slab connection members forming part of or connected to the basket, wherein the positioning includes: (a) positioning a plurality of the load transfer dowels at a first area where a first contraction joint will be formed between a first pair of longitudinally adjacent concrete slabs of the section of the roadway or floor, and (b) positioning one of the slab connection members at a second area where a second contraction joint will be formed between a second pair of transversely adjacent concrete slabs of the section of the roadway or floor, and such that the slab connection members will connect the second pair of transversely adjacent concrete slabs; pouring the concrete for the adjacent concrete slabs of the section of the roadway or floor; and forming cuts for the contraction joints.

It should further be appreciated from the above that the present disclosure provides in certain embodiment a method of forming a section of a roadway or floor, wherein the method includes positioning a concrete slab load transfer and connection apparatus on a sub-grade, said concrete slab load transfer and connection apparatus including: (i) a plurality of load transfer dowels, (ii) a basket supporting the load transfer dowels, and (iii) a plurality of slab connection members forming part of or connected to the basket, wherein the positioning includes: (a) positioning a first plurality of the load transfer dowels at a first area where a first contraction joint will be formed between first and second longitudinally adjacent concrete slabs of the section of the roadway or floor, (b) positioning a second plurality of the load transfer dowels at a second area where a second contraction joint will be formed between third and fourth longitudinally adjacent concrete slabs of the section of the roadway or floor, (c) positioning one of the slab connection members at a third area where a third contraction joint will be formed between the first and third concrete slabs of the section of the roadway or floor, and such that said slab connection member will connect said transversely adjacent first and third concrete slabs; and (d) positioning one of the slab connection members at a fourth area where a fourth contraction joint will be formed between the second and fourth concrete slabs of the section of the roadway or floor, and such that said slab connection member will connect said transversely adjacent second and fourth concrete slabs; pouring the concrete for the first, second, third, and fourth concrete slabs of the section of the roadway or floor; and forming cuts for the contraction joints.

It should further be appreciated from the above that the present disclosure provides in certain embodiments a method of forming a section of a roadway or floor, wherein the method includes positioning a concrete slab load transfer and connection apparatus on a sub-grade, said concrete slab load transfer and connection apparatus including: (i) a plurality of load transfer dowels, (ii) a basket supporting the load transfer dowels, and (iii) a plurality of slab connection members forming part of or connected to the basket, wherein the positioning includes: (a) positioning a plurality of the load transfer dowels at a first area where a first contraction joint will be formed between a first pair of longitudinally adjacent concrete slabs of the section of the roadway or floor, and (b) positioning one of the slab connection members at a second area where a second contraction joint will be formed between a second pair of transversely adjacent concrete slabs of the section of the roadway or floor, and such that said slab connection member will connect the second pair of transversely adjacent concrete slabs; pouring the concrete for the adjacent concrete slabs of the section of the roadway or floor; and forming cut the first and second contraction joints.

Various changes and modifications to the above-described embodiments described herein will be apparent to those skilled in the art. These changes and modifications can be made without departing from the spirit and scope of this present subject matter and without diminishing its intended advantages. Not all of the depicted components described in this disclosure may be required, and some implementations may include additional, different, or fewer components from those expressly described in this disclosure. Variations in the arrangement and type of the components; the shapes, sizes, and materials of the components; and the manners of attachment and connections of the components may be made without departing from the spirit or scope of the claims as set forth herein. Also, unless otherwise indicated, any directions referred to herein reflect the orientations of the components shown in the corresponding drawings and do not limit the scope of the present disclosure. This specification is intended to be taken as a whole and interpreted in accordance with the principles of the invention as taught herein and understood by one of ordinary skill in the art.

The invention is claimed as follows:

1. A concrete floor or roadway comprising:

a first concrete slab;

a second concrete slab longitudinally adjacent to the first concrete slab;

a third concrete slab transversely adjacent to the first concrete slab;

a fourth concrete slab longitudinally adjacent to the third concrete slab and transversely adjacent to the second concrete slab; and a slab load transfer and connection apparatus including:

a first set of load transfer dowels positioned at a first contraction joint formed between the first concrete slab and the second concrete slab, the first set of load transfer dowels configured for load transfer between the longitudinally adjacent first and second concrete slabs;

a second set of load transfer dowels spaced apart from the first set of load transfer dowels and positioned at a second contraction joint formed between the third concrete slab and the fourth concrete slab, the second set of load transfer dowels configured for load transfer between the longitudinally adjacent third and fourth concrete slab; and a basket supporting the first and second set of load transfer dowels said basket including:

a first basket leg including an upper elongated member and a lower elongated member, wherein the first basket leg is partially encapsulated within the transversely adjacent first concrete slab and the third concrete slab;

a second basket leg spaced apart from the first basket leg, the second basket leg including an upper elongated member and a lower elongated member, wherein the second basket leg is partially encapsulated within the transversely adjacent second concrete slab and the fourth concrete slab, such that movement of the first and third concrete slabs in a first direction away from the second and fourth concrete slabs causes movement of the first basket leg in the first direction but does not cause movement of the second basket leg in the first direction and does not cause movement of the second and fourth concrete slabs in the first direction;

a first slab connection member positioned at a third contraction joint between the first concrete slab and the third concrete slab, the first slab connection member fixedly connecting the transversely adjacent first and third concrete slabs such that movement of one of the first concrete slab and the third concrete slab in a third direction causes movement of the other one of the first concrete slab and the third concrete slab in the third direction, wherein the first slab connection member is integrally formed with at least one of the upper elongated member and the lower elongated member of the first basket leg; and a second slab connection member positioned at a fourth contraction joint formed between the second concrete slab and the fourth concrete slab, the second slab connection member fixedly connecting the transversely adjacent second and fourth concrete slabs such that movement of one of the second concrete slab and the fourth concrete slab in a fourth direction causes movement of the other one of the second concrete slab and the fourth concrete slab in the fourth direction, wherein the second slab connection member is integrally formed with at least one of the upper elongated member and the lower elongated member of the second basket leg.

2. The concrete floor or roadway of claim 1, wherein the first basket leg further includes a first upper elongated member and a second upper elongated member and the second basket leg further includes a first upper elongated member and a second upper elongated member.

3. The concrete floor or roadway of claim 2, wherein the first slab connection member includes an elongated rod having two opposing ends integrally and respectively connected to the first upper elongated member and the second upper elongated member of the first basket leg and wherein the second slab connection member includes an elongated rod having two opposing ends integrally and respectively connected to the first upper elongated member and the second upper elongated member of the second basket leg.

4. The concrete floor or roadway of claim 1, wherein the first slab connection member includes an elongated body, a first downwardly extending leg, and a second downwardly extending leg spaced apart from the first downwardly extending leg, and wherein the second slab connection member includes an elongated body, a first downwardly extending leg, and a second downwardly extending leg spaced apart from the first downwardly extending leg.

5. The concrete floor or roadway of claim 4, wherein the first slab connection member elongated body is connected to the first basket leg upper elongated member and the first slab connection member first and second downwardly extending legs are each connected to the first basket leg upper elongated member and lower elongated member, and wherein the second slab connection member elongated body is connected to the second basket leg upper elongated member and the second slab connection member first and second downwardly extending legs are each connected to the second basket leg upper elongated member and lower elongated member.

6. The concrete floor or roadway of claim 1, wherein the first slab connection member includes a cylindrical rod having a first rod end connected to the first basket leg lower elongated member and a second rod end connected to the first basket leg upper elongated member, and wherein the second slab connection member includes a cylindrical rod having a first rod end connected to the second basket leg lower elongated member and a second rod end connected to the second basket leg upper elongated member.

7. A concrete slab load transfer and connection apparatus comprising:

a first slab load transfer and connection apparatus configured to transfer load of a first plurality of adjacent concrete slabs including:

a first set of load transfer dowels configured for load transfer of a first pair of longitudinally adjacent concrete slabs of the first plurality of adjacent concrete slabs;

a second set of load transfer dowels spaced apart from the first set of load transfer dowels configured for load transfer of a different second pair of longitudinally adjacent concrete slabs of the first plurality of adjacent concrete slabs; and a first basket supporting the first and second set of load transfer dowels, the first basket including:

a first basket first leg including a lower elongated member and an upper elongated member, wherein the first basket first leg is partially encapsulated within a first pair of transversely adjacent concrete slabs of the first plurality of adjacent concrete slabs;

a first basket second leg spaced apart from the first basket first leg and including a lower elongated member and an upper elongated member, wherein the first basket second leg is partially encapsulated within a different second pair of transversely adjacent concrete slabs of the first plurality of adjacent concrete slabs such that movement of the first pair of transversely adjacent slabs in a first direction away from the different second pair of transversely adjacent concrete slabs causes movement of the first basket first leg in the first direction but does not cause movement of the first basket second leg in the first direction and does not cause movement of the different second pair of transversely adjacent slabs in the first direction;

a first slab connection member integrally formed with at least one of the upper elongated member and the lower elongated member of the first basket first leg, the first slab connection member configured to form a first fixed connection fixedly connecting the first pair of transversely adjacent concrete slabs of the first plurality of adjacent concrete slabs such that movement of one slab of the first pair of transversely adjacent concrete slabs in a second direction causes movement of the other slab of the first pair of transversely adjacent concrete slabs in the second direction; and a second slab connection member integrally formed with at least one of the upper elongated member and the lower elongated member of the first basket second leg, the second slab connection member configured to form a second fixed connection fixedly connecting the different second pair of transversely adjacent concrete slabs of the first plurality of adjacent concrete slabs such that movement of one slab of the different second pair of transversely adjacent concrete slabs in a third direction causes movement of the other slab of the different second pair of transversely adjacent concrete slabs in the third direction;

a second slab load transfer and connection apparatus configured to transfer load of a different second plurality of adjacent concrete slabs including:

a third set of load transfer dowels configured for load transfer of a third pair of longitudinally adjacent concrete slabs of the different second plurality of adjacent concrete slabs;

a fourth set of load transfer dowels spaced apart from the third set of load transfer dowels configured for load transfer of a different fourth pair of longitudinally adjacent concrete slabs of the different second plurality of adjacent concrete slabs; and a second basket supporting the third and fourth set of load transfer dowels, the second basket including:

a second basket first leg including a lower elongated member and an upper elongated member, wherein the second basket first leg is partially encapsulated within a third pair of transversely adjacent concrete slabs of the different second plurality of adjacent concrete slabs;

a second basket second leg spaced apart from the second basket first leg and including a lower elongated member and an upper elongated member, wherein the second basket second leg is partially encapsulated within a different fourth pair of transversely adjacent concrete slabs of the different second plurality of adjacent concrete slabs such that movement of the third pair of transversely adjacent slabs in a fourth direction away from the different fourth pair of transversely adjacent concrete slabs causes movement of the second basket first leg in the fourth direction but does not cause movement of the second basket second leg in the fourth direction and does not cause movement of the different fourth pair of transversely adjacent slabs in the fourth direction;

a third slab connection member integrally formed with at least one of the upper elongated member and the lower elongated member of the second basket first leg, the third slab connection member configured to form a third fixed connection fixedly connecting the third pair of transversely adjacent concrete slabs of the different second plurality of adjacent concrete slabs such that movement of one slab of the third pair of transversely adjacent concrete slabs in a fifth direction causes movement of the other slab of the third pair of transversely adjacent concrete slabs in the fifth direction;

a fourth slab connection member integrally formed with at least one of the upper elongated member and the lower elongated member of the second basket second leg, the fourth slab connection member configured to form a fourth fixed connection between the different fourth pair of transversely adjacent concrete slabs of the different second plurality of adjacent concrete slabs such that movement of one slab of the different fourth pair of transversely adjacent concrete slabs in a sixth direction causes movement of the other slab of the different fourth pair of transversely adjacent concrete slabs in the sixth direction; and a plurality of basket and slab connection members connecting the first basket and the second basket, wherein a first one of the plurality of basket and slab connection members includes a cylindrical rod having two opposing ends respectively connected to the first basket first leg upper elongated member and the second basket first leg upper elongated member, the first one of the plurality of basket and slab connection members configured to form a fifth fixed connection fixedly connecting one slab of the second pair of longitudinally adjacent slabs of the first plurality of adjacent concrete slabs and one slab of the third pair of longitudinally adjacent slabs of the different second plurality of adjacent concrete slabs, and wherein a second one of the plurality of basket and slab connection members includes a cylindrical rod having two opposing ends respectively connected to the first basket second leg upper elongated member and the second basket second leg upper elongated member, the second one of the plurality of basket and slab connection members configured to form a sixth fixed connection fixedly connecting the other slab of the second pair of longitudinally adjacent slabs of the first plurality of adjacent concrete slabs and the other slab of the third pair of longitudinally adjacent slabs of the different second plurality of adjacent concrete slabs.

8. The concrete slab load transfer and connection apparatus of claim 7, wherein the first slab connection member is positionable at a first contraction joint between and for connecting the first pair of transversely adjacent concrete slabs of the first plurality of adjacent concrete slabs, and wherein the second slab connection member is positionable at a second contraction joint between and for connecting the second pair of transversely adjacent concrete slabs of the first plurality of concrete slabs.

9. The concrete slab load transfer and connection apparatus of claim 7, wherein the first set of load transfer dowels is positionable at a third contraction joint for transferring loads of the first pair of longitudinally adjacent concrete slabs of the first plurality of concrete slabs, and wherein the second set of load transfer dowels is positionable at a fourth contraction joint for transferring loads of the second pair of longitudinally adjacent concrete slabs of the first plurality of concrete slabs.

10. The concrete slab load transfer and connection apparatus of claim 7, wherein the third set of load transfer dowels is positionable at a fifth contraction joint for transferring loads of the third pair of longitudinally adjacent concrete slabs of the different second plurality of concrete slabs, and wherein the fourth set of load transfer dowels is positionable a sixth contraction joint for transferring loads of the fourth pair of longitudinally adjacent concrete slabs of the second plurality of concrete slabs.

11. The concrete slab load transfer and connection apparatus of claim 8, wherein the first and second contraction joints extend longitudinally between the first and second pair of transversely adjacent concrete slabs in a roadway or a floor.

12. The concrete slab load transfer and connection apparatus of claim 7, further comprising a plurality of basket linkage members, wherein the first and second basket and slab connection members connect the first and second baskets using the plurality of basket linkage members.

13. The concrete slab load transfer and connection apparatus of claim 12, wherein the plurality of basket linkage members include tubular sleeves configured to fit around the respective ends of the first basket and slab connection member, the first basket first leg upper elongated member, the second basket first leg upper elongated member, the second basket and slab connection member, the first basket second leg upper elongated member, and the second basket second leg upper elongated member.

14. The concrete slab load transfer and connection apparatus of claim 12, wherein the plurality of basket linkage members each include a tubular ring and upwardly extending supporting arms, the tubular ring configured to fit around the respective ends of the first basket first leg upper elongated member, the second basket first leg upper elongated member, the first basket second leg upper elongated member and the second basket second leg upper elongated member, and the upwardly extending supporting arms defining a slot configured to receive the respective ends of the first basket and slab connection member and the second basket and slab connection member.

15. A concrete slab load transfer and connection apparatus comprising:

a first slab load transfer and connection apparatus including:
- a first set of load transfer dowels;
- a second set of load transfer dowels spaced apart from the first set of load transfer dowels; and
- a first basket supporting the first and second set of load transfer dowels, the first basket including:
  - a first basket first leg including a lower elongated member and an upper elongated member;
  - a first slab connection member integrally formed with at least one of the upper elongated member and the lower elongated member of the first basket first leg;
  - a first basket second leg spaced apart from the first basket first leg and including a lower elongated member and an upper elongated member; and
  - a second slab connection member integrally formed with at least one of the upper elongated member and the lower elongated member of the first basket second leg;

a second slab load transfer and connection apparatus including:
- a third set of load transfer dowels;
- a fourth set of load transfer dowels spaced apart from the third set of load transfer dowels; and
- a second basket supporting the third and fourth set of load transfer dowels, the second basket including:
  - a second basket first leg including a lower elongated member and an upper elongated member;
  - a third slab connection member integrally formed with at least one of the upper elongated member and the lower elongated member of the second basket first leg;
  - a second basket second leg spaced apart from the second basket first leg and including a lower elongated member and an upper elongated member;
  - a fourth slab connection member integrally formed with at least one of the upper elongated member and the lower elongated member of the second basket second leg;

a plurality of basket and slab connection members connecting the first basket and the second basket, wherein a first one of the plurality of basket and slab connection members includes a cylindrical rod having two opposing ends respectively connected to the first basket first leg upper elongated member and the second basket first leg upper elongated member and wherein a second one of the plurality of basket and slab connection members includes a cylindrical rod having two opposing ends respectively connected to the first basket second leg upper elongated member and the second basket second leg upper elongated member; and a plurality of basket linkage members, wherein the first and second basket and slab connection members connect the first and second baskets using the plurality of basket linkage members, and wherein the plurality of basket linkage members include tubular sleeves configured to fit around the respective ends of the first basket and slab connection member, the first basket first leg upper elongated member, the second basket first leg upper elongated member, the second basket and slab connection member, the first basket second leg upper elongated member, and the second basket second leg upper elongated member.

16. A concrete slab load transfer and connection apparatus comprising:

a first slab load transfer and connection apparatus including:
- a first set of load transfer dowels;
- a second set of load transfer dowels spaced apart from the first set of load transfer dowels; and
- a first basket supporting the first and second set of load transfer dowels, the first basket including:
  - a first basket first leg including a lower elongated member and an upper elongated member;
  - a first slab connection member integrally formed with at least one of the upper elongated member and the lower elongated member of the first basket first leg;

a first basket second leg spaced apart from the first basket first leg and including a lower elongated member and an upper elongated member; and a second slab connection member integrally formed with at least one of the upper elongated member and the lower elongated member of the first basket second leg;

a second slab load transfer and connection apparatus including:

a third set of load transfer dowels;

a fourth set of load transfer dowels spaced apart from the third set of load transfer dowels; and a second basket supporting the third and fourth set of load transfer dowels, the second basket including:

a second basket first leg including a lower elongated member and an upper elongated member;

a third slab connection member integrally formed with at least one of the upper elongated member and the lower elongated member of the second basket first leg;

a second basket second leg spaced apart from the second basket first leg and including a lower elongated member and an upper elongated member;

a fourth slab connection member integrally formed with at least one of the upper elongated member and the lower elongated member of the second basket second leg;

a plurality of basket and slab connection members connecting the first basket and the second basket, wherein a first one of the plurality of basket and slab connection members includes a cylindrical rod having two opposing ends respectively connected to the first basket first leg upper elongated member and the second basket first leg upper elongated member and wherein a second one of the plurality of basket and slab connection members includes a cylindrical rod having two opposing ends respectively connected to the first basket second leg upper elongated member and the second basket second leg upper elongated member; and a plurality of basket linkage members, wherein the first and second basket and slab connection members connect the first and second baskets using the plurality of basket linkage members, and wherein the plurality of basket linkage members each include a tubular ring and upwardly extending supporting arms, the tubular ring configured to fit around the respective ends of the first basket first leg upper elongated member, the second basket first leg upper elongated member, the first basket second leg upper elongated member and the second basket second leg upper elongated member, and the upwardly extending supporting arms defining a slot configured to receive the respective ends of the first basket and slab connection member and the second basket and slab connection member.

* * * * *